US007563152B2

(12) United States Patent
Liu

(10) Patent No.: US 7,563,152 B2
(45) **Date of Patent: *Jul. 21, 2009**

(54) BRASSIERE

(75) Inventor: Zhen Qiang Liu, Shenzhen (CN)

(73) Assignee: Regina Miracle International Limited, Hong Kong (HK)

( * ) Notice: Subject to any disclaimer, the term of this patent is extended or adjusted under 35 U.S.C. 154(b) by 0 days.

This patent is subject to a terminal disclaimer.

(21) Appl. No.: 11/560,231

(22) Filed: Nov. 15, 2006

(65) Prior Publication Data

US 2007/0066181 A1 Mar. 22, 2007

Related U.S. Application Data

(60) Division of application No. 11/169,046, filed on Jun. 28, 2005, now Pat. No. 7,192,332, which is a continuation of application No. 10/987,818, filed on Nov. 12, 2004, now abandoned.

(51) Int. Cl.
*A41C 3/00* (2006.01)

(52) U.S. Cl. ..... 450/39; 450/92; 450/93; 450/58

(58) Field of Classification Search ..... 450/39, 450/1, 92, 93, 94, 58; 2/96, 78.1–78.4, 73; 264/157, 257, 258, 291, 292, 294, 320, 321, 264/164, 145, 148, 160; 24/588.12, 592.1, 24/695, 697.2

See application file for complete search history.

(56) References Cited

U.S. PATENT DOCUMENTS 2,664,571 A 1/1954 Kempel
2,834,352 A 5/1958 Murry
2,867,818 A 1/1959 Creamer
2,896,631 A 7/1959 Block
3,528,140 A * 9/1970 Waldes ..... 24/695
3,620,222 A 11/1971 Block
3,772,899 A * 11/1973 Novi ..... 66/176
4,008,029 A 2/1977 Shokite
4,080,416 A 3/1978 Howard
4,183,121 A * 1/1980 Cousins ..... 24/588.1
4,202,853 A 5/1980 DiTullio
4,250,137 A 2/1981 Riedler
5,820,443 A * 10/1998 Burr ..... 450/40

(Continued)

FOREIGN PATENT DOCUMENTS

JP 2000-34604 2/2000

*Primary Examiner*—Gloria Hale
(74) *Attorney, Agent, or Firm*—Ostrolenk, Faber, Gerb & Soffen, LLP

(57) ABSTRACT

A molded and seamless brassiere includes interior and exterior brassiere panels, each of at least one ply of a moldable material. At least one of the plies of the exterior panel is contiguous with at least one of the plies of the interior panel. The panels are affixed together with a clasp adhered between the interior and exterior panels, for capturing the clasp intermediate of said interior and exterior brassiere panels. The clasp is affixed to and at least in part projects from one of the interior or exterior brassiere panels, and one of the brassiere panels includes an aperture for that part of said clasp that projects from said interior and exterior brassiere panels to extend through. The clasp may be a hook and an eye. The interior and exterior brassiere panels may be affixed together around a perimeter of the interior panel.

21 Claims, 18 Drawing Sheets

U.S. PATENT DOCUMENTS 6,042,608 A 3/2000 Ishikawa et al.
6,796,876 B2 9/2004 Luk
6,837,771 B2 * 1/2005 Falla ..... 450/39
6,863,589 B2 * 3/2005 Cano ..... 450/65
6,878,033 B2 4/2005 Luk
6,881,123 B1 4/2005 Klakauskas
7,128,635 B1 * 10/2006 Liu ..... 450/39

* cited by examiner

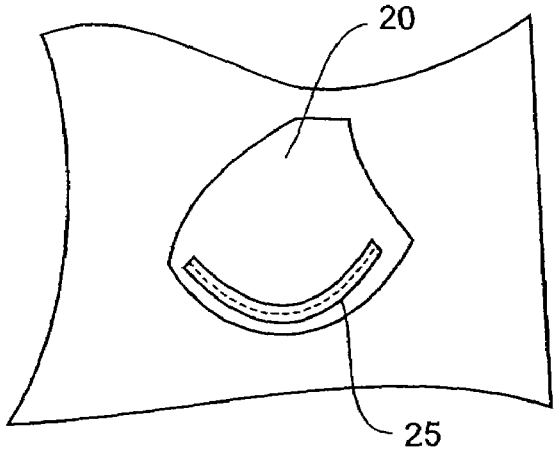
FIGURE 9
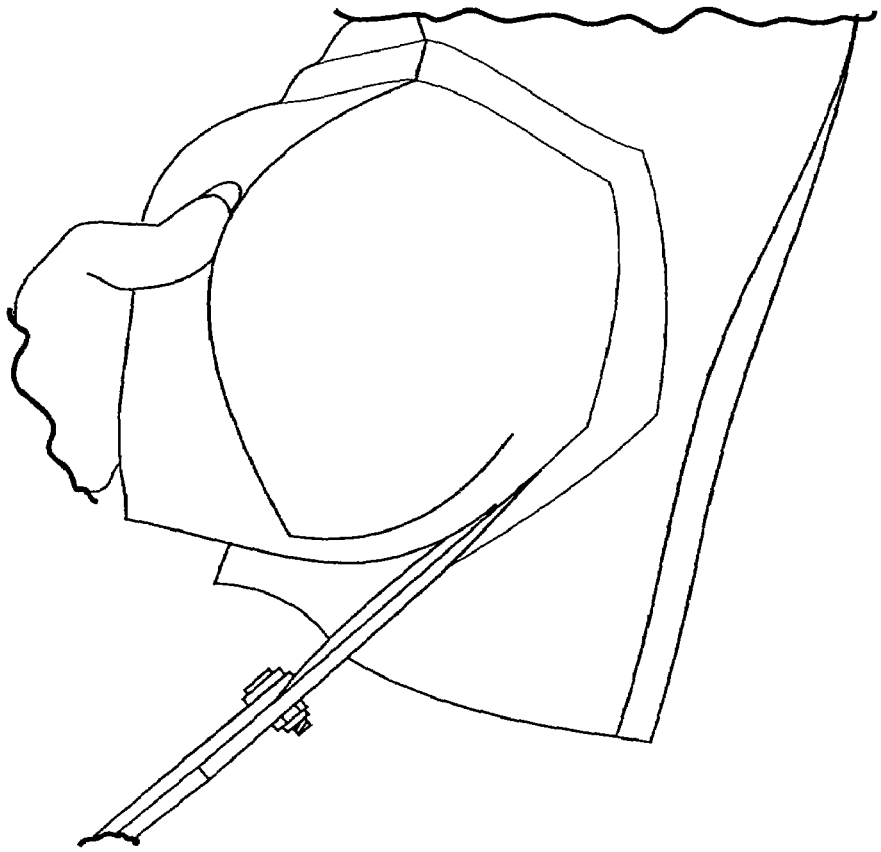

BRASSIERE

PRIORITY CLAIM

This is a division of U.S. patent application Ser. No. 11/169,046, filed Jun. 28, 2005, now U.S. Pat. No. 7,192,332, which is continuation-in-part of U.S. patent application Ser. No. 10/987,818, filed Nov. 12, 2004, now abandoned.

FIELD OF THE INVENTION

The present invention relates to improvements to a bra and related methods of its construction.

BACKGROUND TO THE INVENTION

Bras of a kind which are made from a plurality of layers or plies of material which have been subjected to molding and trimming are known. Molded bras offer the benefit of convenient construction since the materials used lend themselves conveniently to the introduction of a three dimensional cup shape to define the breast cups of a bra by a molding device. Such a device is normally a molding press having appropriately shaped mold portions (an upper and lower mold portion) intermediate of which a pre-form planar ply or assembly of plies of materials can be placed whereupon the molding press can then introduce the three dimensional shape into the plies.

This process avoids the time consuming steps of creating a three dimensional cup form by the more traditional method of stitching together a plurality of panels of material, each cut to an appropriate perimeter shape. While speed of production is an important factor to the manufactures of such bras, aesthetics and comfort factors are also important as these will distinguish the final product from competing products, at the point of sale.

Some of the materials used in the known molded forms of bras, lend themselves to being subjected to heat (and/or adhesive) to allow for such materials to be bonded to other material of the bra. This allows for an assembly of plies of material of a bra to be laminated together. It has however been an issue in respect of bras of the molded kind, to ensure that the perimeter of the bra is capable of being defined in a robust manner. Perimeter stitching or overlooking ensures that the perimeter remains in tact and is not subjected to fraying over a reasonable life span of the bra.

Perimeter stitching usually involves the provision of a hem by some of the plies of the bra about the perimeter which is then stitched onto itself to define a hem about part of or all of the perimeter of the bra. Alternatively, a separate piping like hem may be stitched about the perimeter.

However, stitching or overlooking can be a time consuming step in the manufacturing of a bra. It also requires accuracy in the stitch line in order for the appearance of the bra to remain attractive. Furthermore stitching can be prone to becoming undone or damaged resulting in the integrity of the perimeter of the bra being affected. The stitching itself and the material of the bra immediately adjacent to the stitching can also cause comfort issues to the wearer of a bra. Discomfort to a wearer is an undesirable result of a bra. Therefore the provision of stitching or overlooking to the perimeter of a bra can be undesirable.

Accordingly it is an object of the present invention to provide a bra which addresses the abovementioned disadvantages or which will at least provide the public with a useful choice.

It is also an object of the present invention to provide a method of manufacturing a bra which results in a bra which addresses the abovementioned disadvantages or which will at least provide the public with a useful choice.

BRIEF DESCRIPTION OF THE INVENTION

Accordingly in a first aspect the present invention consists in a molded bra defined in part by a layered assembly of a plurality of plies of flexible moldable material, said layered assembly generally defining bra regions of two molded breast cups a bridge intermediate of said two breast cups and a chest band disposed from each of said molded breast cups, said assembly including a. a first of said plies (herein after "outward ply") of a fabric material presenting a first outermost surface of said bra to the convex side of the breast cups of said bra, and b. at least one other of said plies (herein after "inward ply") disposed to the opposite side of said assembly where said outward ply is presented, presenting a second outermost surface of said bra to the concave side of said breast cups of said bra wherein the layered assembly includes at least the inward and outward ply at the entire perimeter about the bra regions and wherein said outward ply has been folded at the perimeter to provide a hem thereof affixed to the inward ply.

Preferably said hem of said outward ply is adhesively affixed to said inward ply.

Preferably the hem is provided about the perimeter about said bra regions.

Preferably said perimeter of said bra regions generally consists of (a) a lower perimeter extending along the bottom edge of said chest band, (b) an outer perimeter extending along the upper edge of at least the regions inward of the distal ends of the chest band and transitioning to extend adjacent or along the outer perimeter edges of each of said breast cups, and (c) a neckline perimeter extending along the upper edges of each of said breast cups.

Preferably the outward ply is parallel to but not laminated with the plies of the remained of the assembly, save for at said hem.

Preferably the outward ply is parallel to but not laminated with the plies of the remained of the assembly at said hem.

Preferably the assembly, at each of the breast cups includes at least one ply of a foam material.

Preferably the foam material provides a flexibly rigid cup form.

Preferably the chest band, at least at regions extending inwardly from the distal ends towards said breast cups, includes no foam plies.

Preferably the chest band includes no foam plies.

Preferably said outward ply and said inward ply are coextensive with each other.

Preferably said inward ply is of a single piece of material.

Preferably said inward ply is of a single piece of fabric material.

Preferably said outward ply carries embroidery.

In a further aspect the present invention consists in a method of forming a hem at a perimeter of part of a chest band of a bra of a kind including a layered assembly of a plurality of plies of flexible moldable material said layered assembly generally defining bra regions of two molded breast cups, a bridge intermediate of said two breast cups and a chest band disposed from each said molded breast cups, said method including, locating a rigid substrate intermediate of a. a chest band region located region of a first of said plies (herein after "outward ply") of a fabric material presenting a first outermost surface of said bra to the convex side of the breast cups of said bra, and b. a chest band region located region of at least one other of said plies (herein after "inward ply") disposed to the opposite side of said assembly where said first outermost ply is presented, presenting a second outermost surface of said bra to the concave side of said breast cups of said bra, said substrate providing part of its perimeter immediately adjacent the edge of said chest band where said hem is to be formed to define a rigid edge for the folding there over of a hem region of said outward ply to engage said outward ply to the inward ply, and removing the rigid substrate from between said inward and outward plies.

Preferably said outward ply is engaged to said inward ply by adhesion bonding at said hem region.

Preferably said hem region of said outward ply is engaged to said inward ply by the use of an intermediate adhesive tape.

In a further aspect the present invention consists in a method of forming a molded bra of kind including a layered assembly of a plurality of plies of flexible moldable material said layered assembly generally defining bra regions of two molded breast cups, a bridge intermediate of said two breast cups and a chest band disposed from each said molded breast cups, said method including, a. laminating onto a ply of fabric material to define the interior most ply of the bra (herein after "inward most ply"), molded breast cups defined by at least one ply of a foam material, to define an interior assembly b. temporarily affixing a rigid substrate template onto said inward most ply, at said regions of said interior most ply where said chest band is to be defined, each said template being of a shape of the chest bands c. trimming said inward most ply about part of said template to define a chest band shaped portion of said inward most ply extending from said molded breast cups d. engaging to said interior assembly a ply of fabric material to define the outermost ply of said bra, e. folding a hem defined region of said outer most ply about the perimeter of said interior assembly and adhesively affixing said hem to the inward most ply.

Preferably said template is removed from said inward most ply prior to the folding and adhesive affixing of said hem.

Preferably said template is removed from said inward most ply after the folding and adhesive affixing of said hem, said template being positioned intermediate of said inward most ply and said outermost ply during folding and adhesive affixing of said hem.

Preferably said adhesive affixing of said hem occurs by an adhesive tape provided to the hem region of the exterior most ply.

Preferably said adhesive tape is heat activateable, the hem being adhered thereby to said inward most ply, by the use of a pinch contact roller.

Preferably said at least one ply of foam material is formed to define at least one breast cup by press moulding a sheet of foam material.

Preferably said sheet of foam material is of a constant thickness.

Preferably said sheet of foam material is of varying thickness.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth. For the purposes of illustrating the invention, there is shown in the drawings a form which is presently preferred. It is being understood however that this invention is not limited to the precise arrangements shown.

A preferred form and methodologies of the present invention will now be described with reference to the accompanying drawings.

BRIEF DESCRIPTION OF THE DRAWINGS

The present invention may be considered to consist in the foregoing and examples of which have been described with reference to the accompanying drawings in which:

FIG. 9 is a plan view of the molded assembly of plies shown in FIG. 6 wherein the assembly of plies of FIG. 5, the underwire assembly and the additional layer of material have been molded and laminated together by the molding press of FIG. 6, FIG. 10 illustrates the cutting of the cup formed core assembly of materials from the excess material shown in FIG. 9.

DETAILED DESCRIPTION OF THE INVENTION

Figure 1:
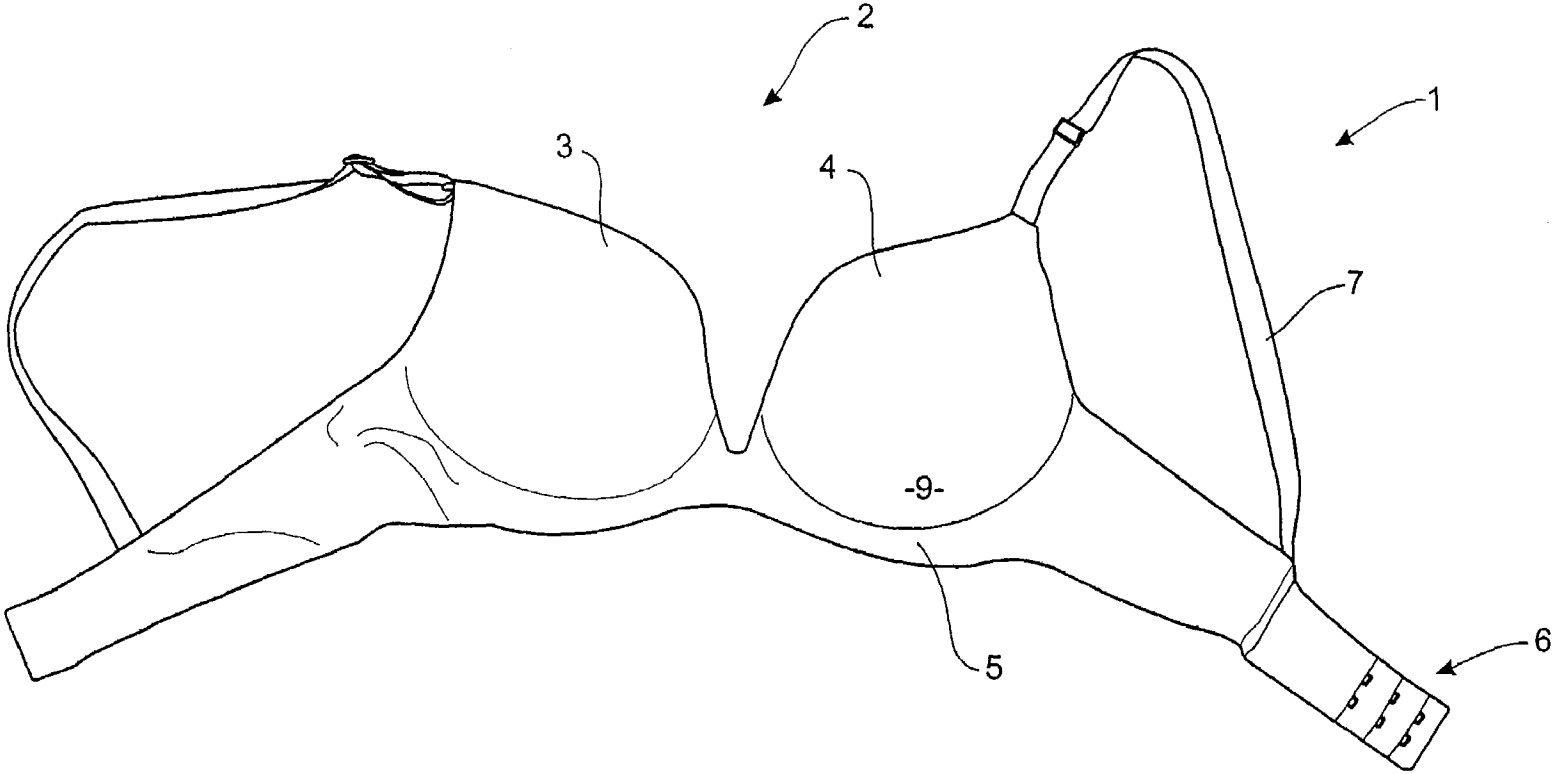
FIG. 1 is a perspective view of a bra of the present invention.
Figure 36:
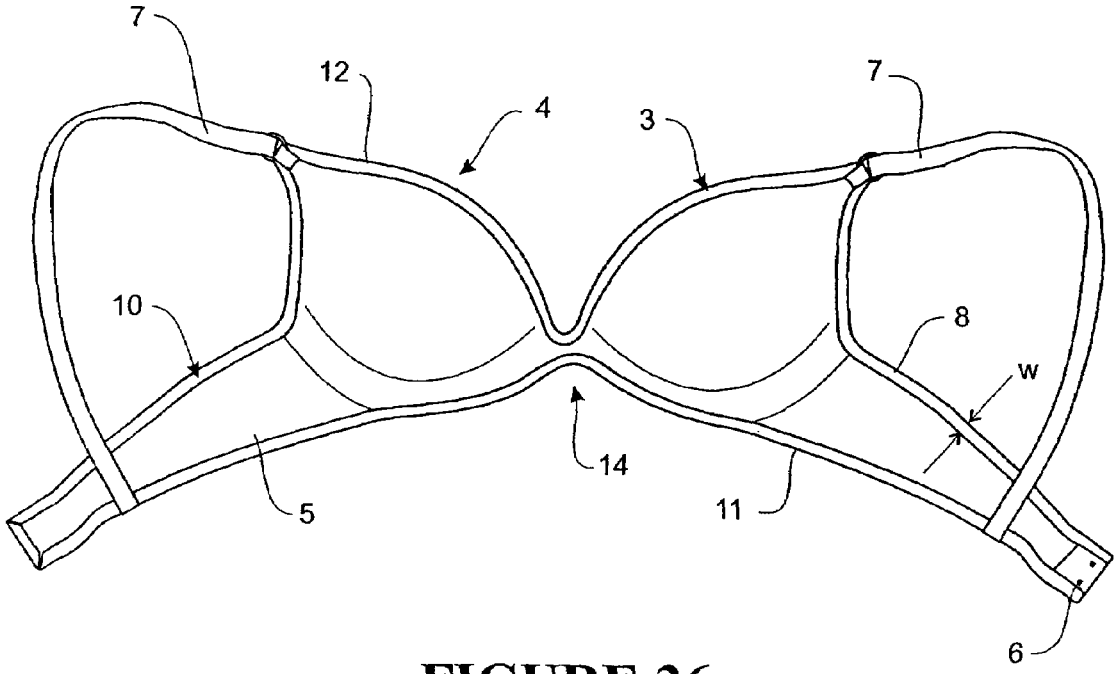
FIG. 36 illustrates a back view of the bra in its final form.

With reference to the accompanying drawings there is shown in FIG. 1, a bra 1 which has been manufactured according to the methodology as hereinafter described. The bra generally consists of a cup region 2 incorporating two breast cups 3, 4 from which there is disposed a chest band region 5 which may include clasps 6 and between which there is disposed over the shoulder straps 7. With reference to FIG. 36 which is a view of the bra of FIG. 1 but from the opposite side, there is shown a perimeter fold over or hem 8 (hereinafter referred to as a "hem") about substantially all of the perimeter region of the bra (save for the over the shoulder straps 7). The hem is formed by the folding of part of the exterior most ply 9 of the bra (disposed to the convex side of the breast cups). The exterior most ply 9 has been folded over the remaining ply or plies of material of the bra about substantially all of the perimeter of the bra as for example shown in FIG. 36. The hem 8 has been created by such folding and by adhesive or weld affixing of that part of the exterior most ply 9 to the interior side of the bra. No stitching is involved in the securing of the exterior most ply 9 to define the hem 8. As a result the breast cup and chest band region of the bra 1 can be formed without the need for stitching to be introduced to secure the various components of the bra together to define the bra as for example shown in FIG. 1. Introduction of stitching to a bra can result in the bra being expensive to manufacture (i.e. time consuming to make) and may at a later stage result in a degradation of the integrity of the bra as a result of the stitching becoming undone. Stitching can also cause discomfort to the wearer of the bra.

The fully assembled bra of the present invention is of a kind which incorporates a ply or plies of foam material within the breast cups 3, 4 but which does not include such foam materials within at least a substantial part of the chest band region 5. Preferred construction details of the bra of FIGS. 1 and 36 will hereinafter be described in conjunction with the explanation of the preferred methodology for the manufacture of the bra.

The hem 8 is preferably only of a width W sufficient to securely and permanently engage the exterior most ply 9 of the bra to the inside (concave side) face of the bra. The hem 8 may for example be between 4-12 mm in width. It preferably extends along the perimeter of the bra which may be defined as the outer perimeter line 10, the lower perimeter line 11 and the neckline perimeter 12 of the bra. Indeed the hem 8 is preferably continuous across the entire neckline 12 for both breast cups 3, 4 extending over the bridge region 14 between the adjacent breast cups 3, 4.

For further details of the assembly of preferred materials to define the bra of the present invention reference will now be made to the preferred method of its manufacture.

Figure 2:
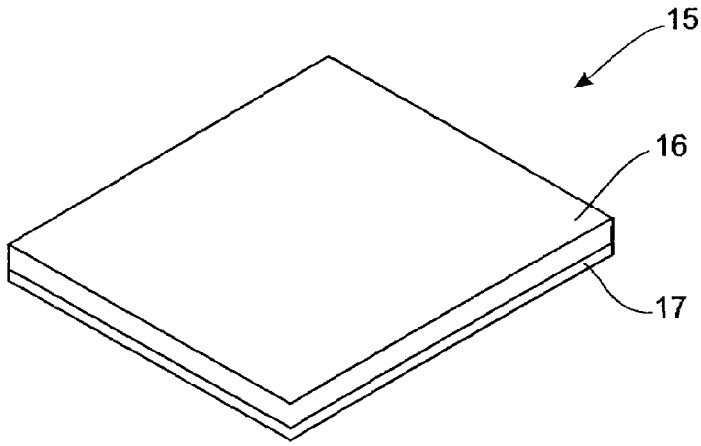
FIG. 2 is a perspective view of a pre-form assembly of plies of material used to define the cup formed core of the bra.
Figure 2A:
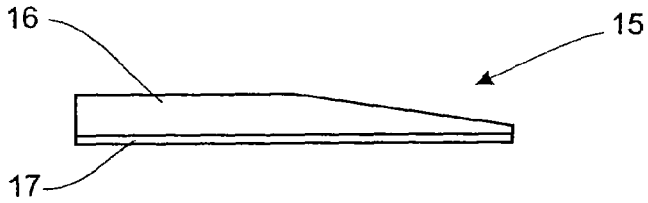
FIG. 2A shows an optional variation to the preformed assembly of plies of material used to define the cup formed core of the bra wherein a reduction or a change in thickness has been introduced to the foam ply.

With reference to FIG. 2 there is shown a precursor assembly of plies of material (the precursor core assembly 15). The precursor core assembly 15 preferably consists of a foam ply 16 laminated to a fabric ply 17. Such lamination may have occurred by heat welding and/or by adhesive. The precursor core assembly 15 may not be of a constant thickness. FIG. 2A for example shows a cross section of a precursor core assembly 15 which has a foam ply 16 of an uneven thickness. It can be seen with reference to FIG. 2A that the foam ply 16 has been reduced in thickness at certain regions. Such certain regions may be of the precursor core assembly 15 where such a variation in thickness is desired to be incorporated in the final bra product. For example at and towards the neckline perimeter of the bra the thickness of the bra may be reduced as a result of a taper introduced in the precursor core assembly. Such a taper may result in a thinner assembly of plies at the neckline perimeter. Likewise a thicker region may be desired at or towards the lower regions of the breast cup for the purposes of providing enhanced support and/or cleavage to the breasts of the wearer. As such the precursor core assembly 15 may be varied in thickness by a variation in thickness of the foam ply 16. Such a variation may be introduced into the foam ply by known techniques including skiving techniques which are known in foam processing technologies.

Figure 3:
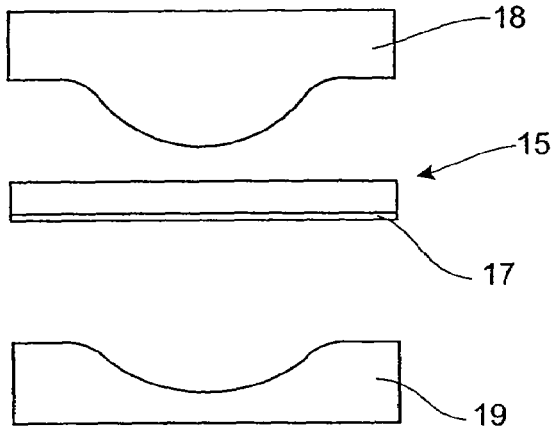
FIG. 3 is a side view of a molding press intermediate of which the assembly of plies of FIG. 2 is positioned prior to such being molded by the molding press.
Figure 4:
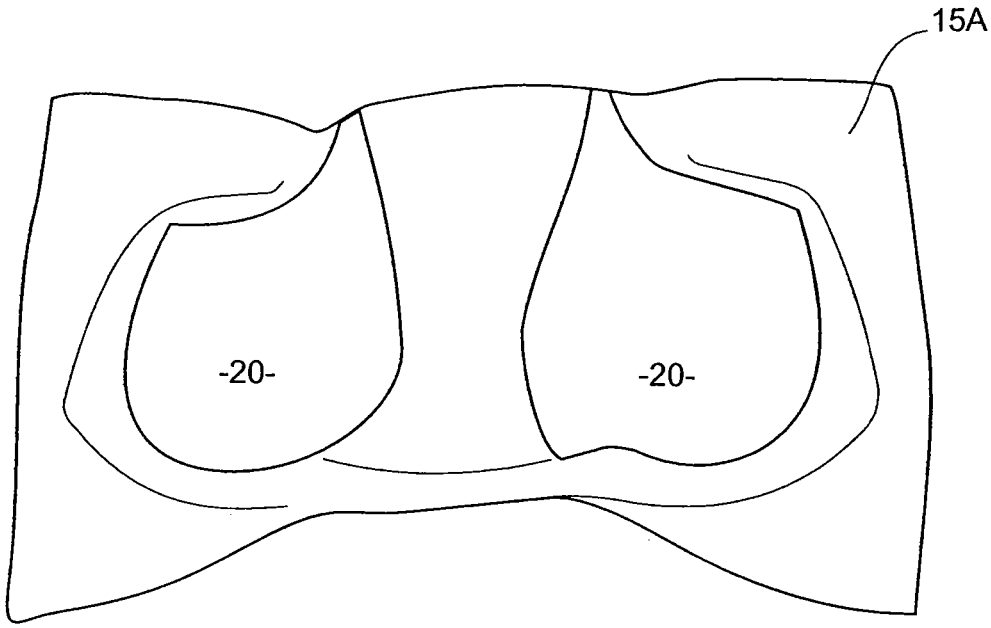
FIG. 4 is a plan view of an assembly of plies as for example shown in FIG. 2 wherein a molding press as per FIG. 3 has introduced two cup forms.
Figure 6:
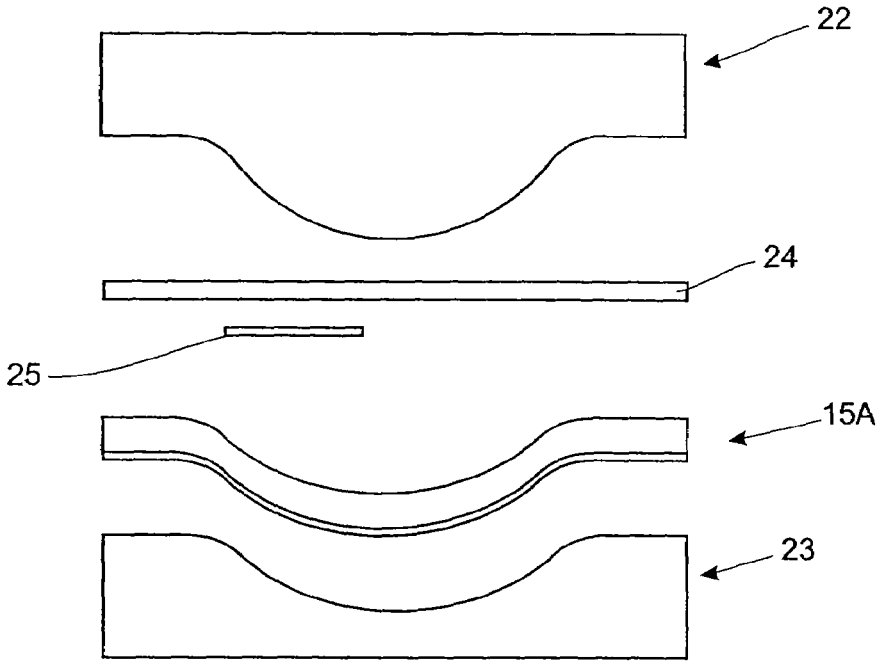
FIG. 6 is a side view of a molding press illustrating the molded assembly of plies of FIG. 5, an underwire assembly and a further layer of material prior to such being molded by the molding press as shown in FIG. 6.

The precursor core assembly 15 is introduced into a molding press consisting of a male mold portion 18 and a female mold portion 19 as for example shown in FIG. 3. The male and female mold portions 18, 19 include complementary shaped relief of a kind which is of a breast cup shaped form. The precursor core assembly 15 is subjected to pressure and preferably heat by the male and female mold portions 18, 19 to introduce a breast cup form into the precursor core assembly 15. The precursor core assembly 15 is placed relative to the molding press so that the fabric ply 17 is disposed to the convex side of the cup form to be molded into the precursor core assembly 15. The foam ply of the precursor core assembly is preferably of a thickness of for example 9 mm and may for example be a polyurethane or memory foam. The fabric ply 17 is preferably of a material such as nylon or spandex. The precursor core assembly 15 may include further plies of material disposed to either or both of the foam and fabric plies 16, 17. With reference to FIG. 4 there is shown the molded form of the precursor core assembly 15 into which two breast cup forms 20 have been introduced. The molding press of FIG. 3 may include two complementary shaped surface relief features in its male and female mold portions 18, 19 to introduce into a single precursor core assembly 15 as for example shown in FIG. 4 the breast cup forms 20 are substantially of a mirror image shape. The then molded precursor core assembly 15A (whether the breast cup forms 20 are cut from the remainder of the material or before such cutting occurs) is subjected to the application of an adhesive. Such an adhesive may be spray applied via a spray nozzle 21 to apply adhesive to at least the breast cup forms 20 of the then molded precursor core assembly 15A. This adhesive is applied to the concave side of the breast cup forms. The purpose of the application of the adhesive is to allow for lamination of further components of the bra to the breast cup forms 20. With reference to FIG. 6 there is illustrated a molding press consisting of a male mold portion 22 and female mold portion 23. Laminated to the then molded precursor core assembly 15A is a further ply of material such as a second foam ply 24. This second foam ply 24 may include further plies of material pre-laminated therewith but in the preferred form is only a single ply of material. However any such additional plies of material may include a further fabric ply either to the upper or lower side of the second foam ply 24. This lamination allows the formation of a cup form which is structurally consistent in shape. The second foam ply, may like the first foam ply 16 shown with reference to FIG. 2A, be of varying thickness. The second foam ply may provide such variation in thickness for similar purposes to allow for a variation in thickness and/or rigidity to be provided to the final form of the breast cups of the bra of the present invention. The second foam ply 24 may be the only foam ply which has such variation in thickness introduced or may in addition to the foam ply 16, be a foam ply which has a variation in thickness introduced.

Figure 7:
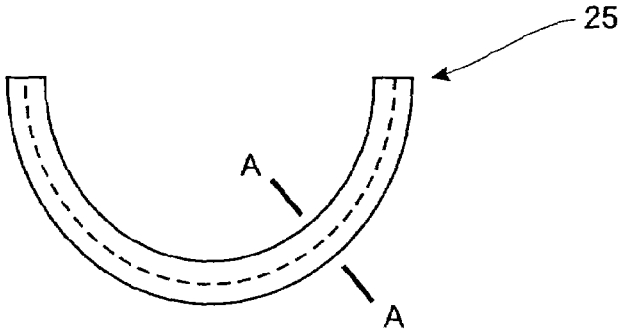
FIG. 7 is a plan view of an underwire assembly.
Figure 8:
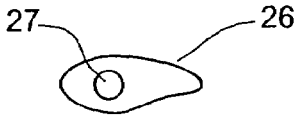
FIG. 8 is a sectional view through Section AA of FIG. 7.
Figure 8A:
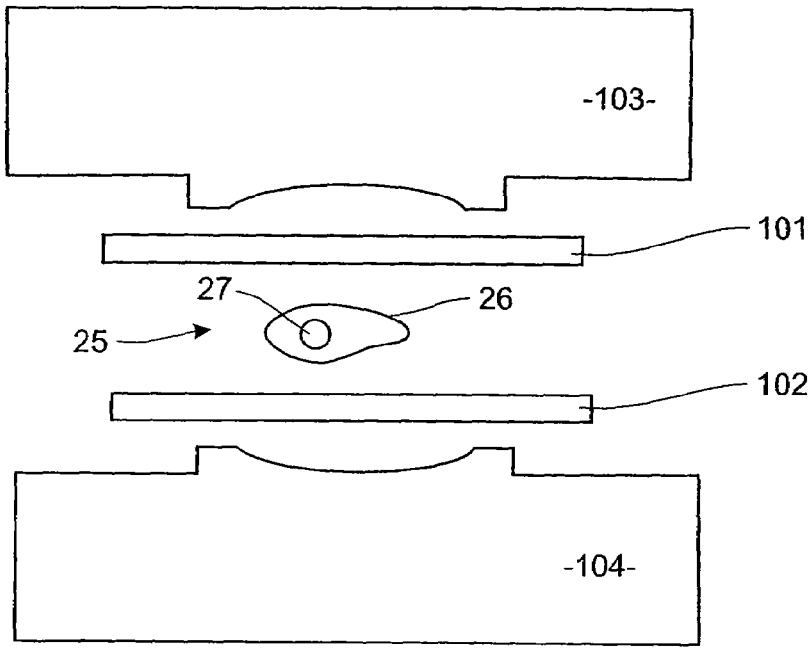
FIG. 8A is a sectional view through a molding step including molding devices for molding a foam sleeve or sock about the underwire assembly of FIGS. 7 and 8.
Figure 8B:
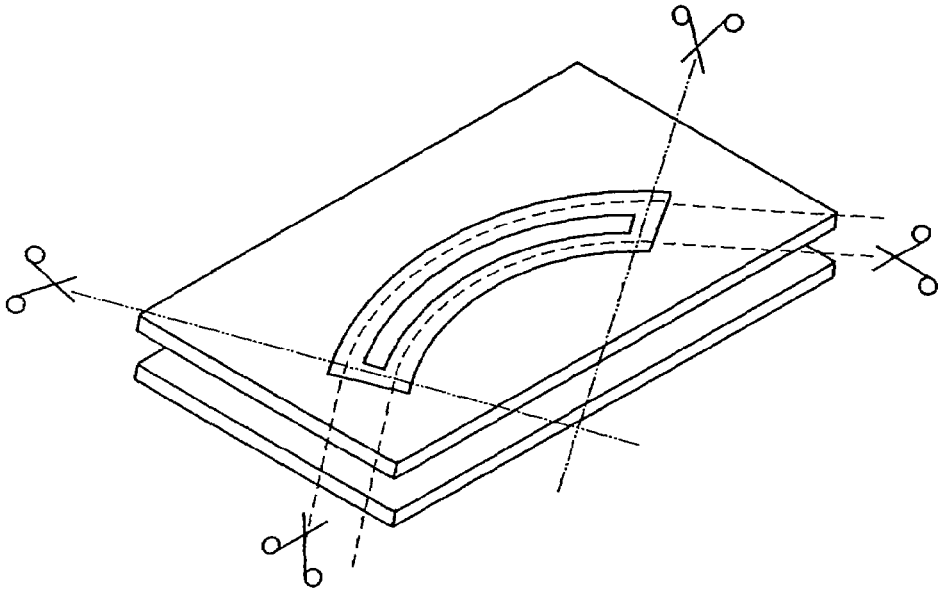
FIG. 8B is a perspective view of the molded assemblies which have been molded in the molding device of FIG. 8A illustrating trim lines to trim a foam enclosed underwire assembly.

Captured between the second foam ply 24 (and any other plies that may be associated therewith) is preferably an underwire assembly 25. The underwire assembly 25 is shown in plan view in FIG. 7 and in sectional view in FIG. 8. The underwire assembly preferably consists of a sock of material 26 within which there is located a flexible but rigid elongate member 27 such as a plastic or metal wire. The underwire assembly 25 is of a curved plan shape. With reference to FIGS. 8A and 8B there is shown an optional addition in respect of the underwire assembly shown in FIG. 7. FIG. 8A illustrates a sectional view through a molding device and wherein two plies of foam 101 and 102 are provided intermediate of which the underwire assembly 25 is placed. The upper and lower mold portions 103, 104 may be moved together to apply pressure and heat to the foam plies 102 and 101 to engage the foam plies together at regions about the underwire assembly 25. Some lamination of the foam plies to the assembly 25 may also occur. The foam plies effectively define a sock about the underwire assembly 25. The resultant product from molding of the step shown in FIG. 8A, is shown in FIG. 8B. Excess foam can be trimmed along the cut lines as shown to define an underwire assembly which has a foam exterior. The foamed underwire assembly has the advantage of providing a softer support to the breasts than the non-foamed underwire assembly of FIG. 7.

It is located intermediate of the second foam ply 24 and the then molded precursor core assembly 15A at a location corresponding to the breast cup form 20 being the lower region of the breast cup form where such an underwire assembly 25 would normally be provided as part of a bra. Molding of the components (as shown in FIG. 6 by the molding press) may require the application of heat over a sufficient dwell time to ensure that a lamination of the components occurs. FIG. 9 illustrates the then assembled laminated and molded components of FIG. 6.

Figure 5:
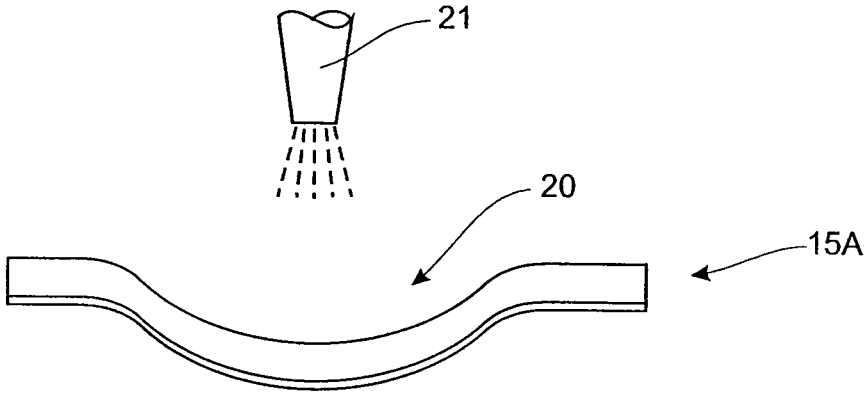
FIG. 5 is a sectional view through the molded assembly of plies of FIG. 2 illustrating the application of an adhesive to at least part of one side of the molded assembly of plies.
Figure 11:
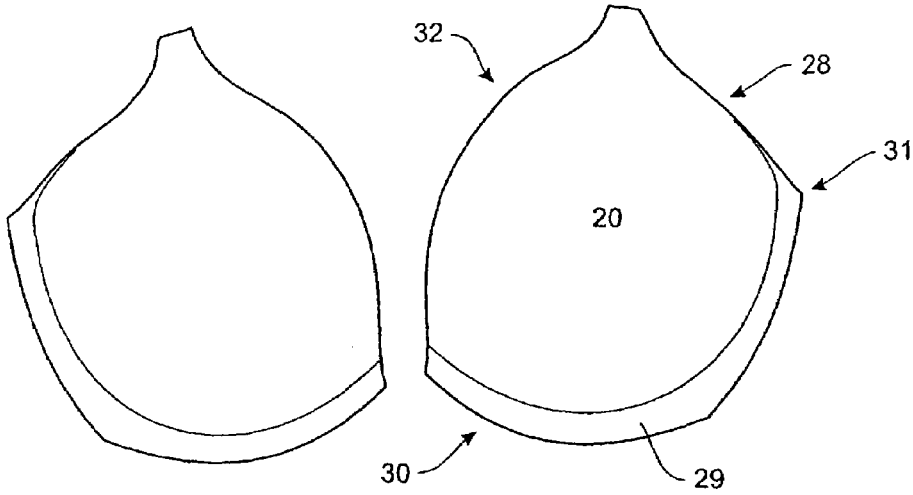
FIG. 11 is a plan view of two mirror imaged cup formed core assemblies of components.

The excess material of the then molded precursor core assembly 15A and the then molded and laminated second foam ply 24 may then be cut to be removed from the breast cup form 20 to define the assembly as shown in FIG. 11. The assembly of FIG. 11 is the breast cup core assembly 28. FIG. 11 illustrates two breast cup core assemblies 28 being a mirror image of each other each to be incorporated into other components to form a bra of the present invention. The breast cup core assembly includes a breast cup form 20 and may also include a flange 29 extending for example about the lower and outer perimeter regions of the breast cup core assembly. The breast cup core assembly includes a lower perimeter region 30, outer perimeter region 31 and neckline perimeter region 32. The core assembly may be of varying thickness. A variation to the steps to define the core assemblies 28 as shown in FIG. 11 may be implemented in order to define a single breast cup core assembly as for example shown in FIG. 11A. The steps shown with reference to FIGS. 3, 5, 6 may all occur where the plies are provided to have two breast cup forms introduced positioned appropriately spaced apart and bridged by a bridging region. Rather than a single breast cup form being molded into the plies as shown with reference to these figures double breast cup forms can be molded so as to allow for a unitary breast cup core assembly 28 to be provided as for example shown in FIG. 11A rather than the two breast cup core assemblies 28 of FIG. 11 which require additional affixing to each other.

Figure 11A:
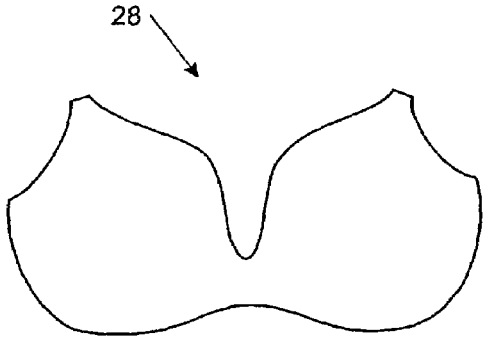
FIG. 11A is a plan view of a core assembly.
Figure 12:
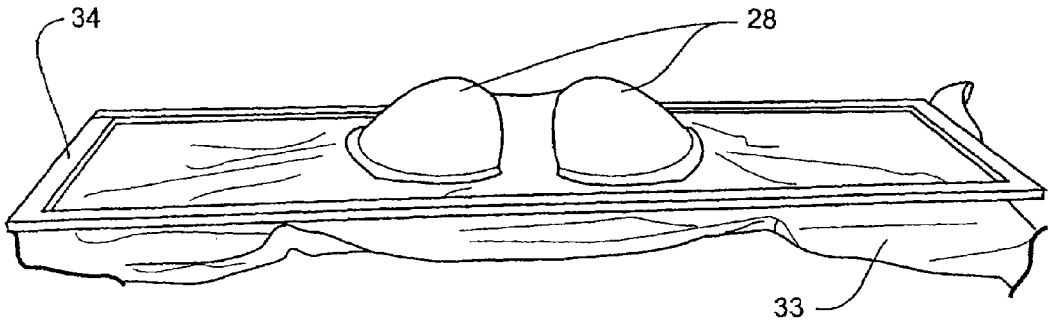
FIG. 12 illustrates the core assembly of components of FIG. 11 located onto a lower molding press component and supported on top of a ply of fabric material with which the core cup assembly of components of FIG. 11 are to be laminated.

The next step in the manufacture of the bra of the present invention is to take one or for example both breast cup core assemblies 28 and laminate to their concave side, a ply of fabric material (the interior most ply 33). With reference to FIG. 12, there can be seen part of a mold press including a perimeter frame 34 to hold the interior most ply 33 onto a male molding portion which includes male surface relief corresponding substantially to the breast cup form or forms of the breast cup core assemblies 28 placed thereon. An upper female relief molding portion of the molding press in part shown in FIG. 12 (the upper portion not being shown) can then apply heat and pressure to the breast cup core assembly or assemblies 28 to press these and laminate these with the interior most ply 33. In one form the interior most ply 33 may be molded and laminated to a breast cup core assembly 28 individually or simultaneously. The simultaneous lamination is for example demonstrated with reference to FIG. 12. As a variation with reference to FIG. 12, the unitary breast cup core assembly 28 of FIG. 11A may be positioned on the interior most ply 33 as a unitary item rather than two items as for example shown in FIG. 12.

The interior most ply 33 is preferably of a material such as nylon or spandex.

Figure 13:
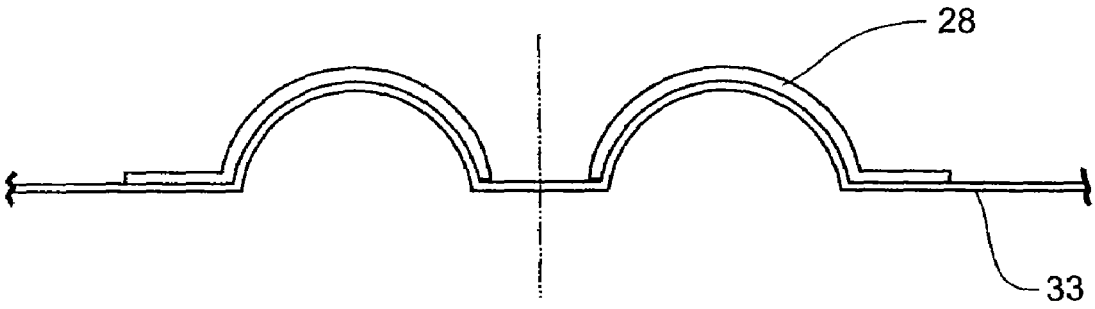
FIG. 13 is a sectional view through a vertical plane of the assembly of materials of FIG. 13 after having been molded, illustrating the core cup assembly components of FIG. 11 laminated with the ply of fabric material.
Figure 14:
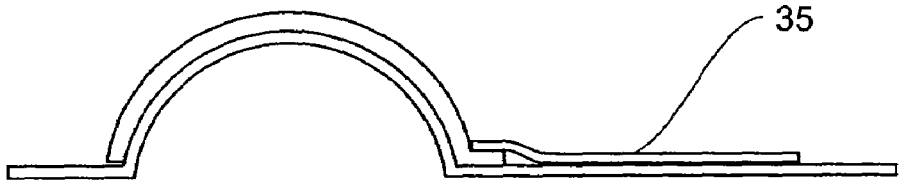
FIG. 14 illustrates the introduction to the laminated assembly of FIG. 13, a layer of a heat resistant material incorporated into the bra during its subsequent manufacturing steps but which is preferably later removed from the components of the bra.
Figure 15:
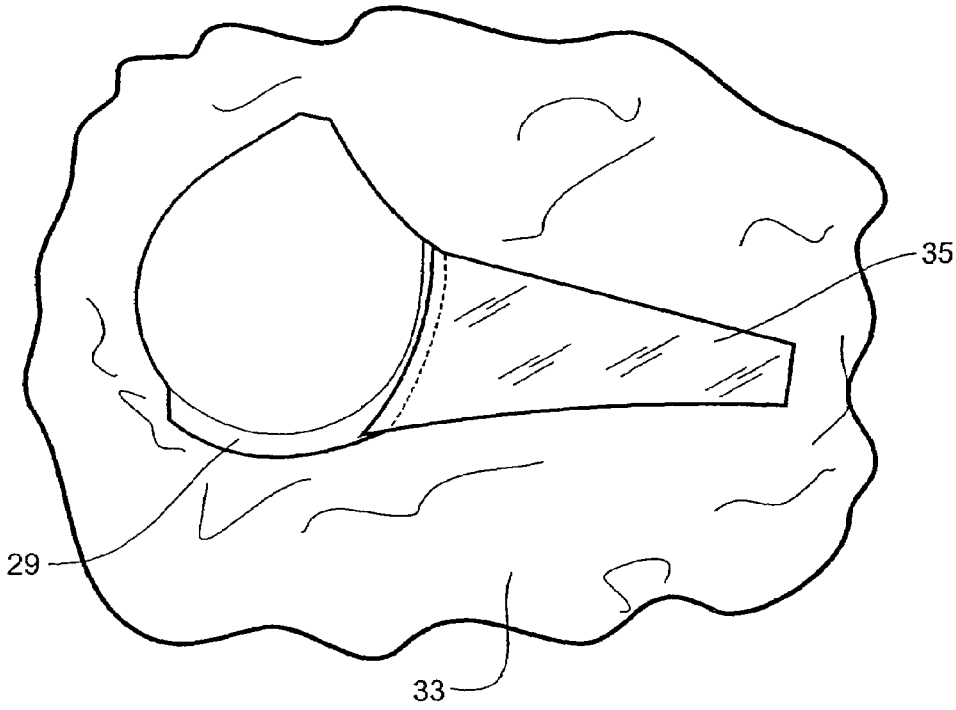
FIG. 15 is a plan view of the laminated assembly of FIG. 13 and illustrating the heat resistant material shown in cross section in FIG. 14.

A vertical cross section through the then molded assembly of the breast cup core assemblies 28 and the interior most ply 33 is for example shown in FIG. 13. The interior most ply 33 is of a size sufficient to also allow for part of the interior most ply 33 to define part of the chest band region 5 of the bra. At this stage some of the perimeter of the interior most ply may be trimmed. That portion of the interior most ply that may be trimmed may be that portion which is immediately adjacent the perimeter of the breast cup core assembly 28 save for at the perimeter of the breast cup core assembly 28 where the wing portions of the bra are to be formed. Alternatively no such trimming at this stage occurs.

The next stage is for a wing shaped panel (wing panel 35) to be placed onto the interior most ply 33 and in part over the flange 29. The wing panel 35 is preferably of a plan shape corresponding to the wing portion of the chest band region 5 of the bra. It is positioned onto the interior most ply 33 in a location where the chest band region 5 of the bra is to be provided in part by the interior most ply 33. The wing panel is placed onto the same side of the interior most ply 33 as where the breast cup core assembly 28 is provided. The wing panel 35 is made from a rigid film material which may have some flexibility. It is preferably slightly sticky or adhesive on one side (that side to engage with the interior most ply 33) and not adhesive on the other side. In one method of the present invention it is provided to prevent any bonding of any other of the layers of the bra provided at this region to the interior most ply 33 on that side thereof where the wing panel 35 is located (other than the hem 8). In this one aspect the wing panel is made from a heat resistant material. In a second aspect, the material need not be heat resistant.

In the first aspect of the method of the present invention the heat resistant wing panel 35 is made from a heat resistant material which is of a kind which may be transparent and non-elastic. The plastic material will not melt below a temperature of for example 180 degrees Celsius. As this temperature will not be reached during the first method of manufacturing of the bra, the heat resistant material will not permanently bond with the plies of material immediately adjacent thereto.

In both the first and second methods of the invention utilizing the wing panel, and as will be explained further on, the wing panel will be removed from the bra by hand.

Figure 16:
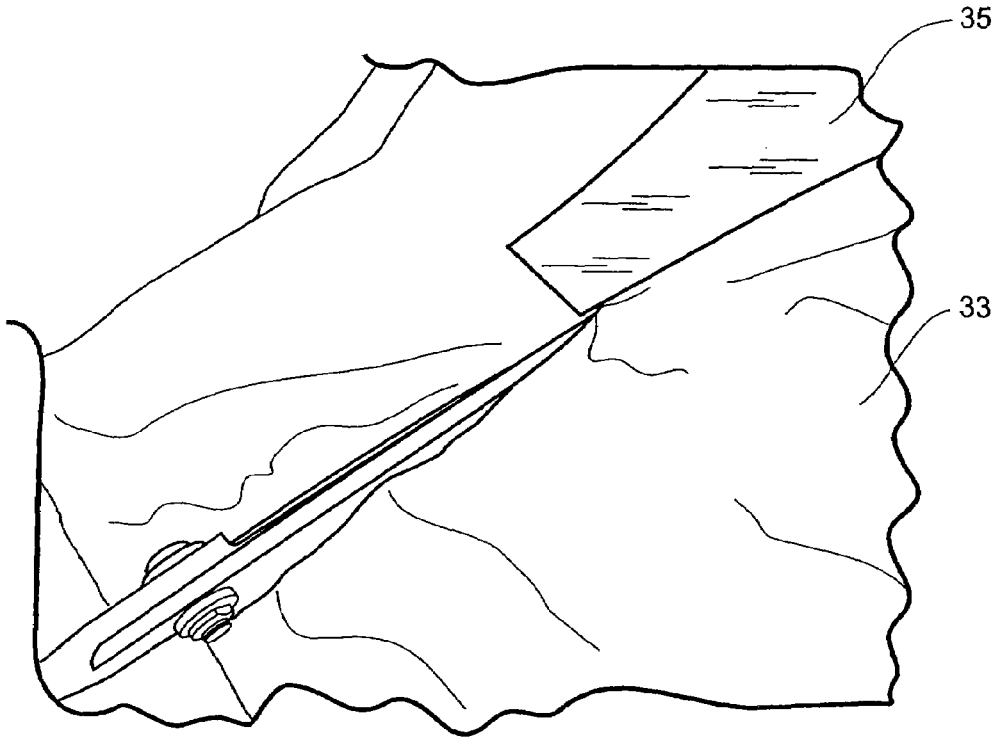
FIG. 16 illustrates the perimeter cutting of the assembly of laminated materials of FIG. 13 to be cut to the approximate perimeter shape of the final form of half of the bra.

The interior most ply 33 may be trimmed to cut away excess material of the interior most ply 33 by cutting parallel (preferably along) the perimeter line of the wing panel 35 and (if not already done so before the wing panel was applied) at least part of the perimeter of the breast cup core assembly. Such cutting is for example demonstrated in FIG. 16 by using scissors or other fabric cutter.

The provision of the wing panel 35 also allows for more accurate dimensioning of the shape of the wing portion of the bra during cutting. This is so because the plies defining the wing portions of the bra do not contain foam or any other shape consistent material and the wing portions are therefore too soft and elastic to be worked on (i.e. cutting accurately). The provision of the wing panel can reduce the dimensional deviation from approximately 2-3 centimeters to only 3 millimeters on average. It also may be provided for the purposes of allowing more convenient working of the material for the subsequent steps of the manufacturing of the bra.

Figure 17:
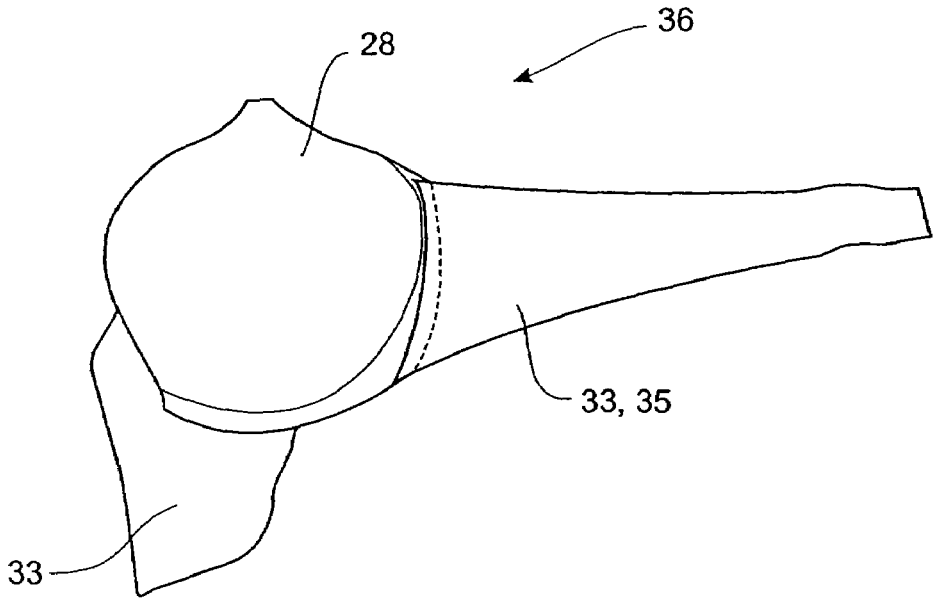
FIG. 17 illustrates the excess material (in particular the ply of fabric material shown in FIG. 12 and FIG. 15) having in part been trimmed away from the assembly of plies which in part define the approximate perimeter of the bra as shown in FIG. 1.
Figure 18:
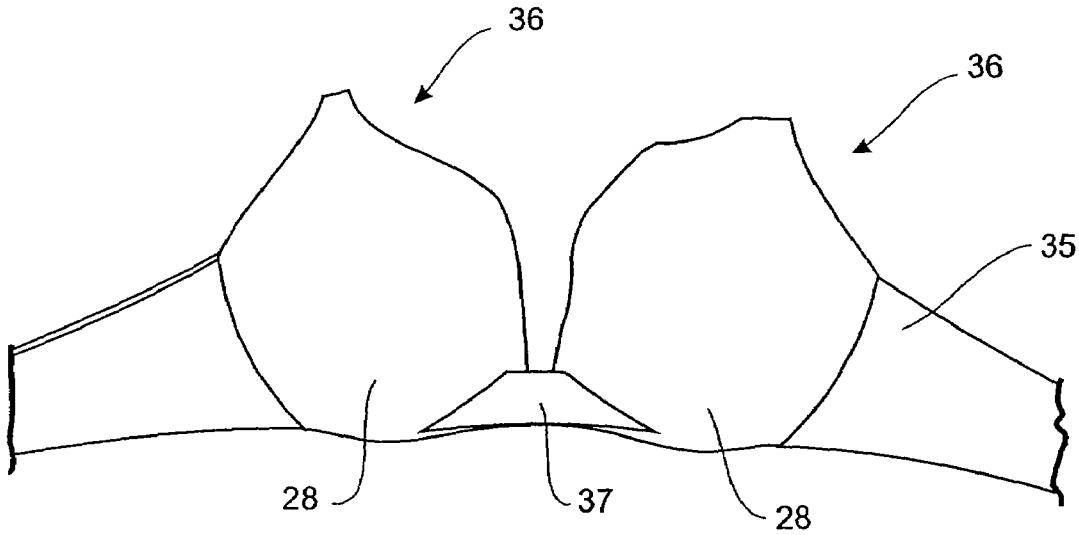
FIG. 18 illustrates the bonding of two mirror image components of FIG. 17 together by the bridging element intermediate of the components of an approximate shape of the perimeter of the bra shown in FIG. 1.

The result of such cutting may define an assembly as for example shown in FIG. 17. The assembly of FIG. 17 is to engage with a mirror image and like assembly at the bridge region 14 of the bra. However in an alternative form creating such bridging may not necessarily need to be an additional step and the interior most ply 33 may remain joined at the bridge region with a like assembly. It may be that both breast cups are laminated to an interior most ply 33 and remain engaged together rather than separating. However where separated the assembly 36 is engaged to a like assembly as for example shown in FIG. 18. Such engagement is by connecting the interior most plies 33 of each of the assemblies 36 together and/or by the provision of a bridging panel 37 to bond the two assemblies 36 together in a condition to dispose the breast cup core assemblies 28 in an appropriate location for their use subsequently as part of the bra. The bridging panel 37 may be of a flexible but non-stretch material to ensure that the breast cup core assemblies 28 cannot move outwardly from each other. Where the unitary breast cup core assembly 28 of FIG. 11A is utilized the assembly of FIG. 17 need not be defined as merely incorporating only one breast cup region. In such an alternative the assembly of FIG. 17 will include both breast cups. Rather than a bridging needing to occur as for example shown with reference to FIG. 18, such bridging has already been provided where the unitary breast cup core assembly 28 of FIG. 11A is utilized. Additional strengthening such as by a bridging panel 37 may still however be provided.

Figure 19:
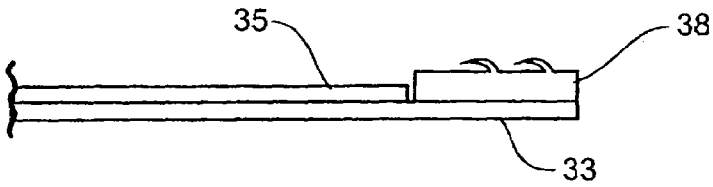
FIG. 19 illustrates a sectional view of part of the chest band of the assembly of plies of FIG. 18 illustrating the application of a fastening means to the distal end of the chest band.
Figure 20:
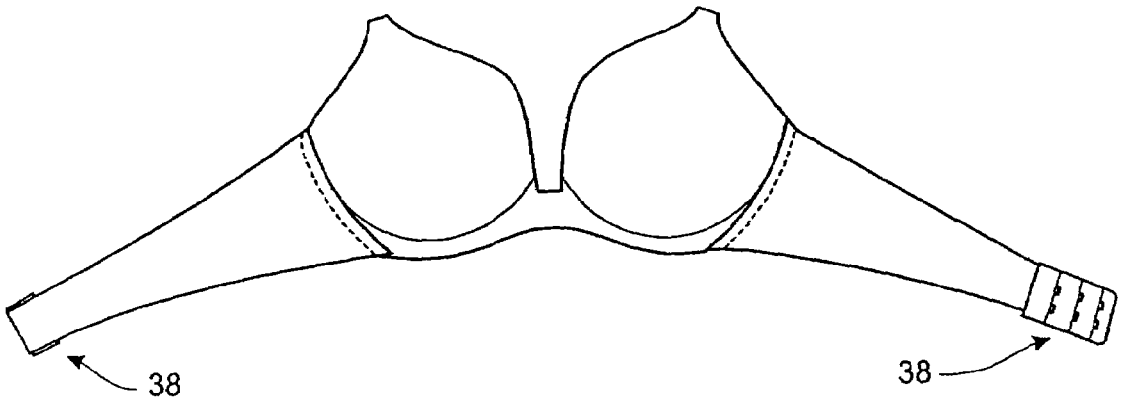
FIG. 20 is a plan view of the assembly of plies of FIG. 18 including the fastening means.

From here the next step is preferably to apply the clasps or catches or taches to the distal ends of the interior most ply 33 of the bra. Preferably the clasps 38 are adhered by an adhesive and/or heat and/or ultrasonic welding to the interior most ply 33. As can be seen with reference to FIG. 19 the clasps 38 are not affixed to the heat resistant wing panel 35. On one of the distal ends of the chest band region 5 of the interior most ply 33 the clasp is provided to the same side of the interior most ply 33 as the heat resistant wing panel 35. The clasps or fastening means 38 may alternatively be affixed by ironing induced fastening with the use of adhesive coated tape or by ultrasonic welding. Alternatively the fasteners may also be stitched but such is less preferred. In a second method of the present invention involving the wing panel 35, the wing panel 35 is at this stage removed from the assembly or assemblies 36. The wing panels in the second method involving the wing panels, have served their purpose of providing rigidity and dimensioning accuracy for the formation of the wing portions of the bra and positioning and affixing of the clasps or fastening means 38. However in a first method of the present invention involving the wing panels, where such wing panels are of a heat resistant material, such wing panels at this stage remain engaged with the assemblies 36 for serving subsequent purposes during further assembly of the bra.

The next stage in the method of manufacturing the bra of the present invention is to prepare the exterior most ply for the bra.

While reference herein has been made to the interior most ply and the exterior most ply, the terms interior and exterior in this regard relate to the plies of material which are outermost on the bra. Reference to the interior most ply is not a ply located within the assembly of materials but is the ply of material which is to be adjacent most the body of the wearer. The outer most ply is the ply of material of the assembly of the bra which in a substantial part, is distal most from the body of the wearer.

Figure 21:
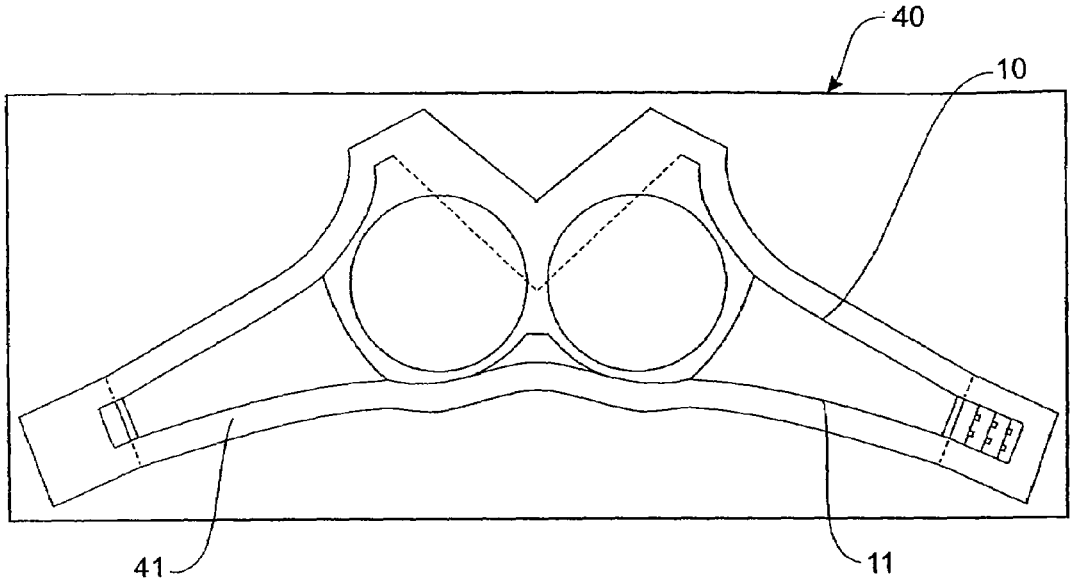
FIG. 21 is a plan view of a template used in the steps of the manufacture of the bra of the present invention and described in more detail hereinafter.

Preparation of the exterior most ply 9 may in a first preferred method, involve the use of a template 40. The template 40 may for example be a substrate of a paper or card like material. Drawn or depicted on the template 40 is an outline of at least the lower perimeter line 11 and outer perimeter line 10 of the final form of the bra. This is as for example shown in FIG. 21. A margin 41 may be drawn about the outer and lower perimeter lines 10, 11 drawn on the template 40. The margin is preferably of a width of a tape 42 to be applied to the template 40 outwardly and immediately adjacent the outer and lower perimeter lines 10, 11. The tape 42 is applied to the margin drawn on the template 40 to follow the outer and lower perimeter lines 10, 11. Such tape is not provided to a region of the template corresponding to the neckline perimeter 12 of the bra. The tape 42 preferably consists of multiple layers and indeed such multiple layers may be applied simultaneously or sequentially. Essentially the tape 42 consists of a first layer of material to be applied directly to the template. It is a heat resistant plaster 43.

This material is sticky on the side facing the template 40 so that it can adhere to the template 40. Applied over the heat resistant plaster 43 is an assembly of layers the first consisting of an adhesive coated tape and the second band of elastic material although the band of elastic material is optional. It may also be optionally provided at wing portions only. The adhesive coated tape is provided at the assembly of this additional layer of tape away from the heat resistant plaster 43. The band of elastic material is provided to adhere to the heat resistant plaster 43. This may be by a suitable adhesive which can result in the sticking of this additional assembly of tape to the heat resistant plaster yet be able to be removed therefrom at a later stage. Glue is applied on the non-sticky side of the heat resistant material so that the elastic band can temporarily stay on the heat resistant material. One side of the adhesive coated tape is sticking on the elastic band. The whole of the template 40 (with the heat resistant plaster, the elastic band and the adhesive coated tape on top of it) is then placed on the thermal pressing machine as is shown in part in FIG. 23 (operating at around 120 degrees Celsius). The exterior most ply 9 is then placed on top of the template 40.

The tape is of a kind which is adhesive on each side. The adhesive applied on both sides of the tape will melt when heated during the process of the manufacture of this bra enabling two plies of material of the bra to be bonded together by the adhesive coated tape. The adhesive coated tape is preferably also slightly elastic and can therefore provide mild elasticity to the material that is bonded. One example of an adhesive coated tape of this kind will result in the adhesive melting slightly at around 120 degrees Celsius. However at around 150 to 160 degrees Celsius the adhesive will completely melt and provide strongest adhesion ability. Normally the adhesive coated tape is supplied from the manufacture where one side of the tape is pre-covered with a non-stick paper which is peeled away for the purpose of exposing the adhesive coated tape for subsequent heat bonding.

The elastic band with which the adhesive coated tape engaged, is of a kind which may for example be one commonly used in garments or bras. The adhesive tape on both sides of the elastic band allows the exterior most ply to be attached to the interior most ply with the elastic band between the two plies along the perimeter of the bra. No stitching is required to affix the elastic band in the bra.

Figure 23:
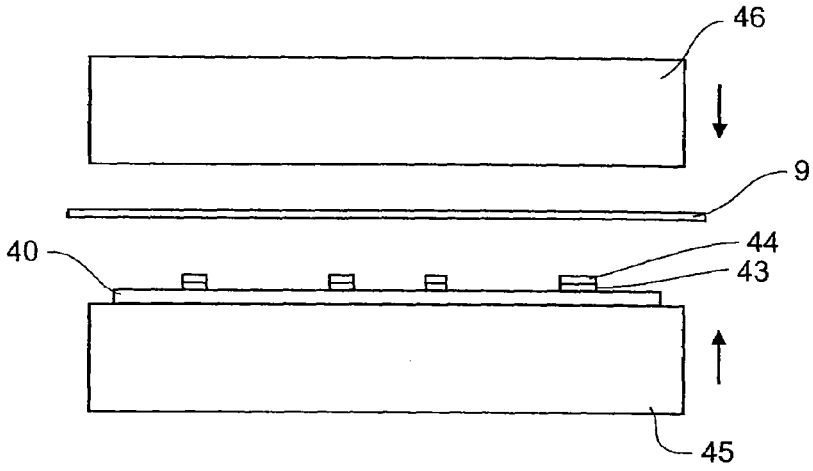
FIG. 23 illustrates a press to laminate the tape applied to the template of FIG. 21 to a ply of fabric material.
Figure 24:
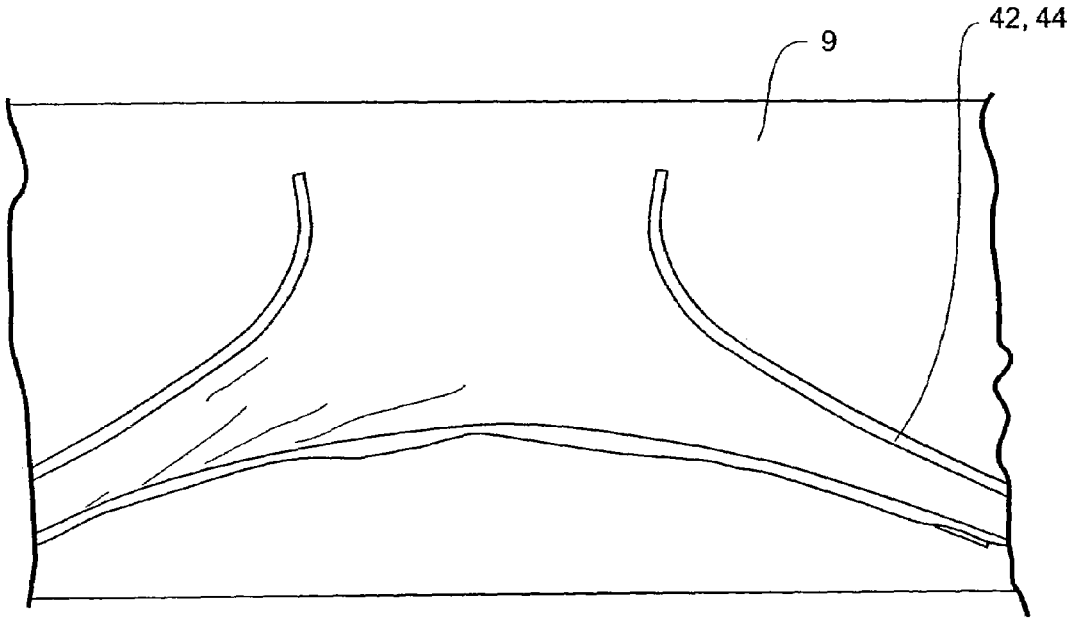
FIG. 24 illustrates the tape of FIG. 22 having been transferred to the ply of fabric material by the press of FIG. 23.

With reference to FIG. 23 there is shown a sectional view of a heating press illustrating the template 40 onto which there is provided the heat resistant plaster 43 and the assembly of plies of tape 44 consisting of the adhesive coated tape and the elastic band. The adhesive coated tape is here provided intermediate of the exterior most ply and the elastic band. Also shown is a ply of fabric material being that which defines the exterior most ply 9. The press consisting of a lower press portion 45 and an upper press portion 46 can apply pressure to the exterior most ply 9 for it to be pressed against the template 40. With the application of heat and sufficient dwell time, a bonding of the adhesive coated tape to the exterior most ply 9 will occur. The transfer is as for example shown in FIG. 24 where the exterior most ply 9 has transferred onto it the assembly 44 at locations corresponding to the outer and lower perimeter lines 10 and 11.

The exterior most ply 9 may be of a material such as nylon or spandex or lycra.

Figure 26:
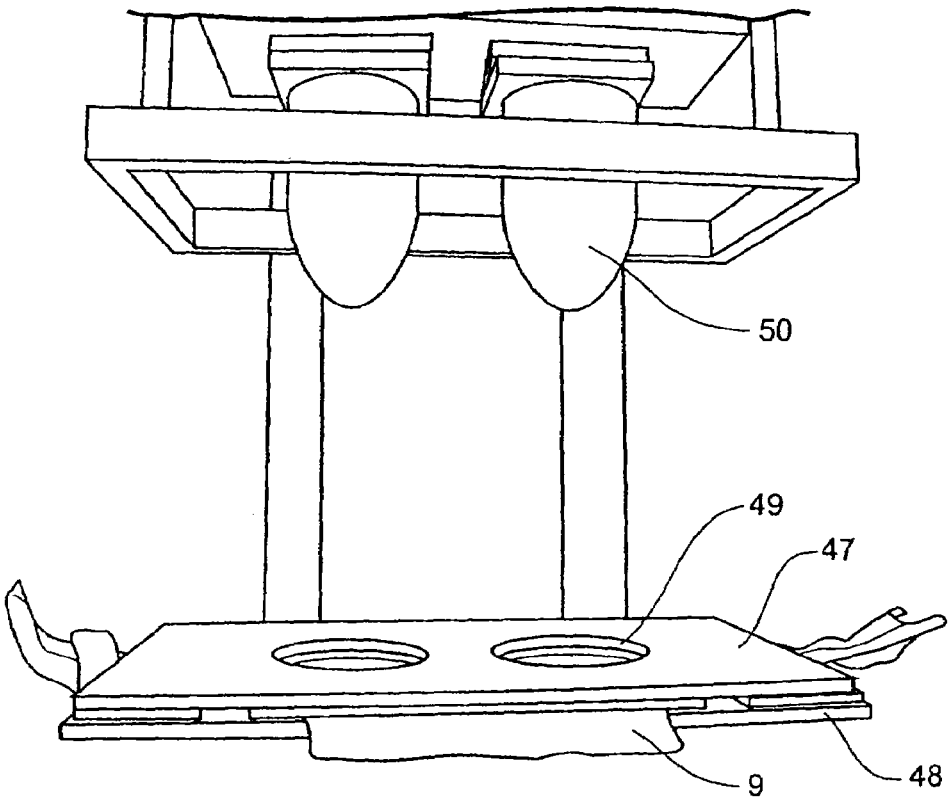
FIG. 26 illustrates a molding device or press to introduce cup forms into the ply of fabric material of FIG. 25.
Figure 27:
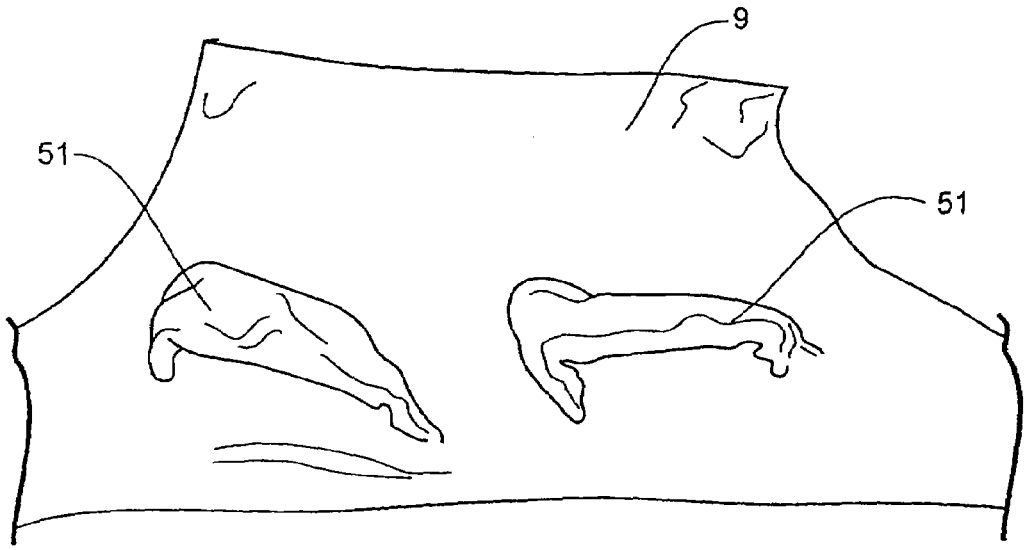
FIG. 27 illustrates part of the ply of fabric material of FIG. 25 into which cup shaped relief has been introduced.
Figure 28:
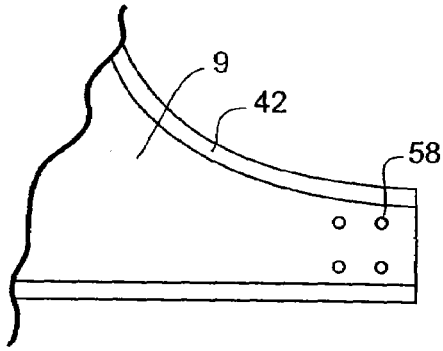
FIG. 28 illustrates the end of the chest band to be located regions of the ply of fabric material of FIG. 25 into which apertures are provided to correspond with the fastening elements of the fasteners engaged to the end of the chest band regions of the assembly of materials of FIG. 21.

The exterior most ply 9 is thereafter trimmed about the tape portions now present (being the second adhesive coating over the elastic band and the then bonded adhesive coating between the elastic band and the fabric) to the outer and lower perimeter line disposed regions thereof. Prior to the application of the exterior most ply 9 to the other components of the bra, the exterior most ply 9 has introduced therein, molded relief provided by a molding device of a kind as for example shown in FIG. 26. The exterior most ply 9 is clamped between two plates 47-48 which includes two apertures 49 to allow the penetration through each of the apertures 49 of molding bullets 50. These molding bullets 50 penetrate through the apertures 49 to an extent as required to introduce into the exterior most ply 9 molded relief. Such relief corresponds to and to allow for the exterior most ply 9 to then be engaged to the other components with the breast cup forms. The molded relief 51 is shown in a non-form defining manner in FIG. 27. The molding bullets 50 are preferably heated to a suitable temperature and in combination with a dwell time, ensure that a permanent deformation of the exterior most ply 9 occurs at the regions thereof to correspond with the breast cup forms.

Figure 22:
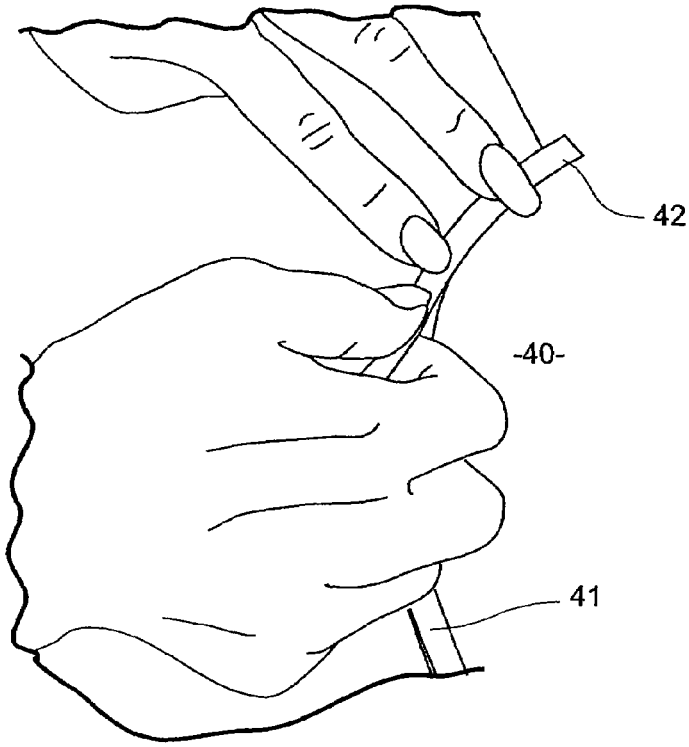
FIG. 22 illustrates the application of a tape like material to the template of FIG. 21 about the base and side perimeter regions of the perimeter shape of the bra drawn on the template and wherein no such tape is applied to the neckline region of the bra illustrated on the template of FIG. 21.
Figure 29:
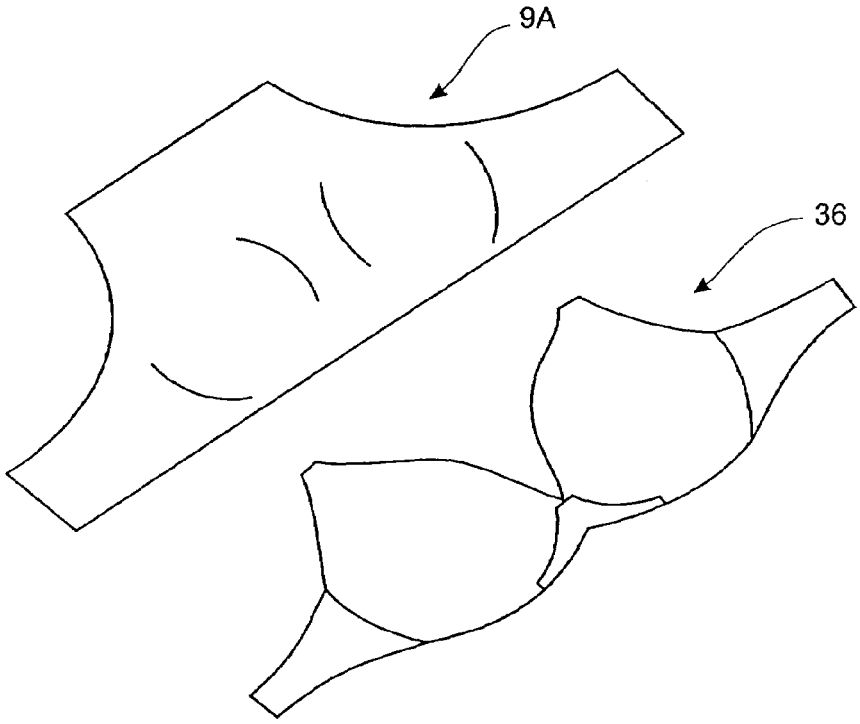
FIG. 29 illustrates the ply of fabric material of FIG. 25 and the assembly of materials of FIG. 21 prior to their being laminated together.
Figure 30:
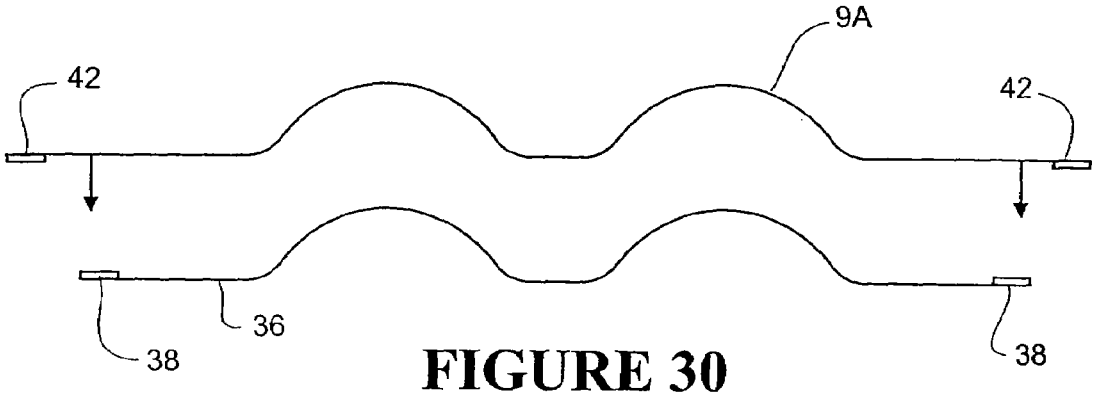
FIG. 30 is a sectional view through the assembly of FIG. 29.

At some stage the exterior most ply 9 may have introduced therewith apertures 58 at a region of the exterior most ply 9 to correspond with the distal ends of the chest band region 5. The apertures 58 may be defined by cutting, such as ultrasonic cutting, laser cutting or physical cutting or any other suitable method. The assembly 36 and the then molded and in part trimmed exterior most ply 9A as shown in FIGS. 29 and 30 are affixed together. Such affixing is such that the exterior most ply 9A is positioned to the convex side of the assembly 36. The exterior most ply 9 is provided to the convex side of the assembly 36 with the tape 42 provided on that side of the exterior most ply facing the assembly 36. Such a relationship is for example shown in FIG. 30. The positioning of the exterior most ply 9 to the assembly 36 is such that the tape applied perimeter or perimeters of the exterior most ply 9 fall outside of the corresponding perimeter of the assembly 36. As a result the tape applied perimeter of the exterior most ply 9A can be manipulated to fold about the adjacent perimeter of the assembly 36. It is such folding and subsequent application of pressure and heat to the perimeter of the exterior most ply at where the tape 42 is applied which will result in an affixing of the assembly 36 with the exterior most ply 9A. An alternative to the first preferred method described above for applying the assembly 44 to the exterior most ply 9 by the use of a template, will now be described. Rather than applying the tape as described with reference to FIGS. 21, 22 and 23 by the use of a template to the exterior most ply 9 before trimming the exterior most ply 9 and then applying it to the assembly 36, in an alternative method the exterior most ply 9 may have its breast cup forms molded therein and then applied to the assembly 36. The exterior most ply 9 may be temporarily affixed to the assembly 36 by for example some adhesive or pins or the like to hold the exterior most ply 9 in place to the assembly 36. The assembly 36 will then define a perimeter to the exterior most ply 9 (which is still in an untrimmed form). It is about the perimeter defined by the assembly 36 to which the tape assembly or assemblies can be applied to the exterior most ply 9. The perimeter of the assembly 36 defines a template of a kind for the positioning of the tape 44 parallel and contiguous thereto. The exterior most ply may then also be trimmed by a trimming device such as scissors or a roller cutting knife or similar about the tape.

The tape may be applied by a device which consists of two surfaces at least one of which is a wheel and in between which the ply 9 can be fed. The two surfaces pinch together and can also draw therein between the tape for it to be pressure applied to the exterior most ply 9. One or both of the wheels may also include heating elements or the wheel may be heated for example to allow application of heat and pressure (see for example FIG. 34A).

Prior to the application of the exterior most ply, the exterior most ply may also be subjected to further steps of providing visually appealing appearance thereto. Such may be by a laser cutting or by stitching to have a lace or an embroidered appearance applied to the exterior most ply.

Figure 31:
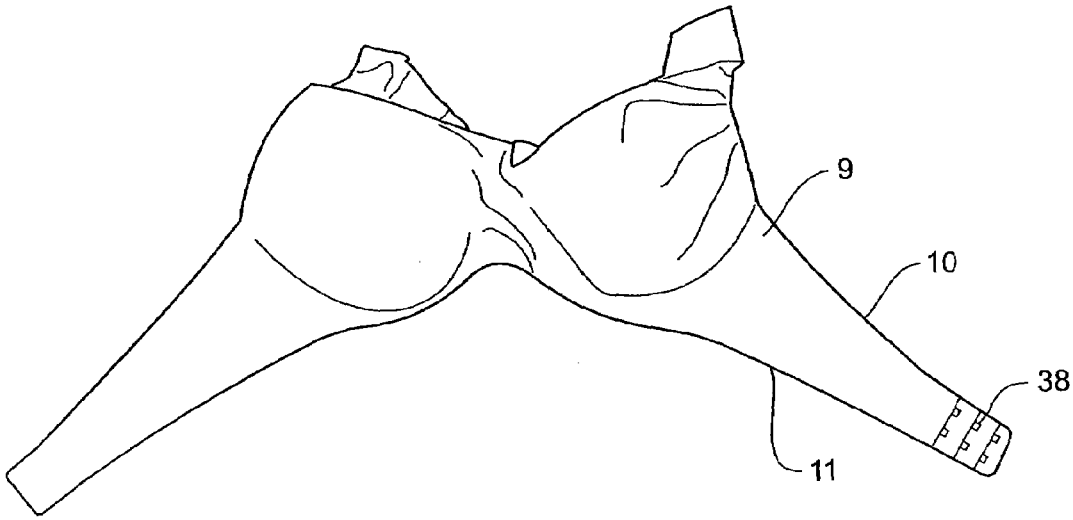
FIG. 31 illustrates the assembly of the fabric ply of FIG. 25 engaged with the assembly of FIG. 20 wherein the lower and outer perimeter regions of the ply of fabric material of FIG. 25 have been folded over the lower and outer perimeter regions of the assembly of FIG. 20 and the tape has been relied on for adhering these perimeter regions of the ply of fabric material of 25 to the inside (concave side) of the assembly of materials of FIG. 20.

With reference to FIG. 31, there is shown a part of the bra of the present invention wherein the exterior most ply 9 has had its tape 42 carrying hem 8 (not shown) folded over the outer and lower perimeter lines 10 and 11 of the assembly 36. In addition to the folding a heating of the hem and application of pressure has occurred which activates the tape 42 (in fact the adhesive coated tape thereof) to bond the hem portion of the exterior most ply 9 to the interior most ply 33 of the assembly 36. With sufficient pressure and heat and dwell time (the heat being in the vicinity of 150 degrees Celsius) strong bonding of the hem 8 of the exterior most ply 9 will occur to the interior most ply 33 at the outer and lower perimeter lines 10, 11.

Figure 32:
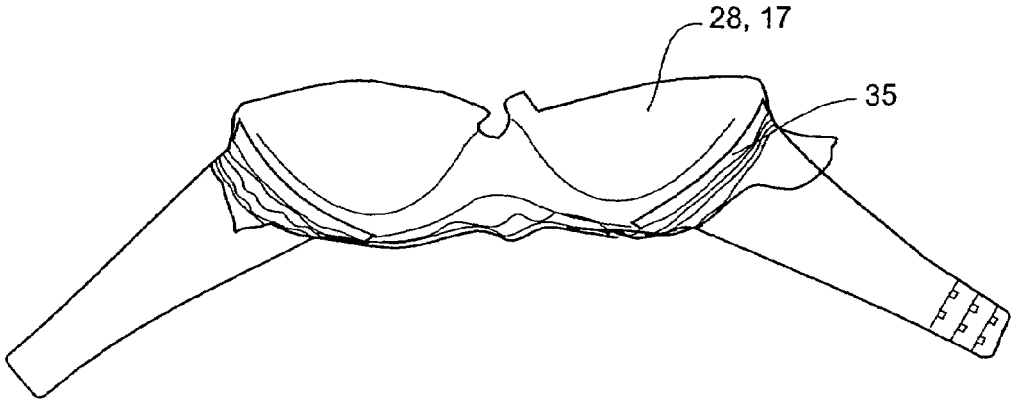
FIG. 32 illustrates the assembly of materials of FIG. 31 but wherein the outer ply of fabric material has been peeled back from the core assembly of materials to expose the core cup formed assemblies.
Figure 33:
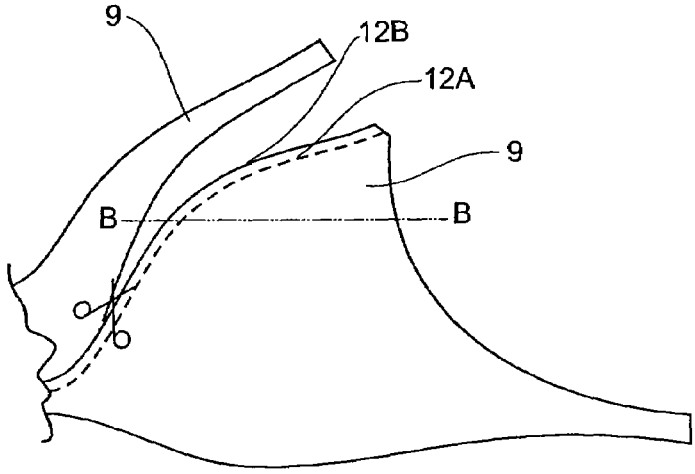
FIG. 33 illustrates the trimming of the excess material of the outer ply of fabric at the neckline.

In a first method of the present invention in respect of the use of the heat resistant wing panel, the application of heat occurs by an iron onto preferably the entire wing portion of the bra as it exists at this stage. As a result of the provision of the heat resistant panel, no bonding of the exterior most ply 9 (other than its hem) occurs with other regions of the assembly 36 at this stage. No iron heat will be applied to the cup regions of the bra at this stage but only to the wing regions. As such the exterior most ply 9 can be peeled back from the assembly 36 as for example shown in FIG. 32. Such partial peeling away of the exterior most ply 9 at least from the core assembly proximate region of the assembly 36 will allow for an exposure of the heat resistant wing panels 35 to occur. Since the heat resistant wing panels 35 are not permanently bonded to any of the bra, such exposure will allow for the heat resistant wing panels 35 to be removed. Pulling out of the cavity defined between the exterior most ply 9 and the assembly 36 at the wing regions of the chest band region 5 will allow for the heat resistant wing panel 35 to be removed. Since the wing regions of the chest band region 5 are suitably tapered, such removal can occur quite conveniently.

Since the wing regions of the chest band 5 do not incorporate any material of significant rigidity (i.e. they preferably do not incorporate any foam material) it may be difficult to manipulate the wing panel regions of the various plies of material of the bra for the purposes of the steps of assembly of the bra. It may be for this reason that the wing panel 35 is employed during the assembly of the present invention. The wing panel is of a material which although flexible has some structural rigidity. Such structural rigidity allows for the outer perimeter line 10 and lower perimeter line 11 at the wing regions of the bra to be and remain clearly defined. It also provides a significantly rigid edge along the part of the outer and lower perimeter lines 10, 11 of the bra at the wing region of the chest band region 5. In a first aspect of the method involving the wing panel, it allows the folding of the hem 8 and the bonding of the hem 8 to the interior most ply 33. Without the heat resistant wing panel 35 being provided during the assembly of the bra it may make it difficult, without special devices other than an iron, to accurately define the hem. This is not so for the perimeter defined by the breast cups since these consist of a number of layers which create a more rigid edge for the exterior most ply to fold about. It may also make it difficult for the hem to be folded about the outer and lower perimeter line defined by the assembly 36. In a second method of the invention relating to the use of the wing panel, the wing panel has at this stage already been removed. Such removal has occurred before the folding of the hem 8 is to occur at the wing region of the interior most ply 33. Rather than utilizing an iron for adhering the exterior and interior most plies at the wing region together to define the hem 8, a more accurate device for creating the hem is utilized. Since there is no heat resistant panel intermediate of the interior and exterior plies the use of an iron may result in the bonding of the interior and exterior plies together other than at a hem region. The device that may be utilised for merely applying heat and pressure at the hem region is a device as for example shown in FIG. 34A and hereinafter described in more detail.

With reference to the first method of the invention involving the wing panel (where the wing panel is a heat resistant wing panel remaining in place during the formation of the hem 8 at the wing portion of the bra), the wing panel requires to be removed once the hem has been formed. As such a method of removal of the wing panel is required. It is for this region that the neckline perimeter of the bra is also not simultaneously bonded at its hemline when the outer and lower perimeter line disposed hem 8 of the exterior most plies are affixed. A subsequent affixing of the hem 8 at the neckline of the breast cup forms allows prior to such affixing, the removal of the heat resistant wing panel.

However as mentioned earlier in the specification it is desirable that substantially the entire perimeter of the bra has a hem provided. As such, once the heat resistant wing panel has been removed it is then possible for the hem 8 at the neckline perimeter 12 of the bra to be affixed. A trimming of excess material of the exterior most ply 9 can occur to follow substantially the neckline perimeter of the assembly 36. However again a margin beyond the neckline perimeter 12A of the assembly 36 may be provided to the neckline edge 12B of the exterior most ply 9. This margin is preferably the same as the margin of the hem 8 to be provided at the neckline perimeter of the bra. A material like that of the tape 42 which is or includes the adhesive coated tape can be applied to the neckline perimeter 12B of the exterior most ply for its subsequent folding of the hem 8 of the exterior most ply 9 about the neckline perimeter 12A of the assembly 36. The application of the adhesive coated tape to the hem region 8 of the exterior most ply 9 at the neckline perimeter may also include the application of an elastic band like that incorporated in the outer and lower perimeter lines 10 and 11 of the bra.

A further reason for not applying any adhesive coated tape to the neckline perimeter of the exterior most ply prior to the exterior most ply having been molded by the bullet molder, is that the neckline perimeter would be very proximate to the regions of the exterior most ply 9 at where the surface relief is molded into the exterior most ply 9 by the bullet molder. As such the neckline perimeter of region of the exterior most ply during such molding will be subjected to heat and if an adhesive coated tape were applied at this point in time the effectiveness of the adhesive coated tape for subsequent use may be affected.

Figure 34:
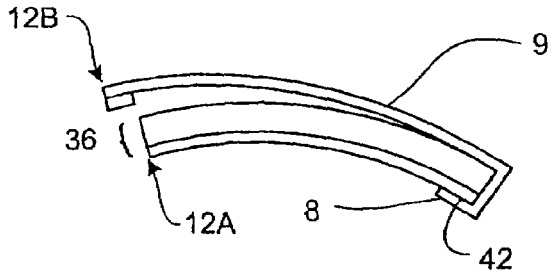
FIG. 34 is a sectional view through section BB of FIG. 33.
Figure 34A:
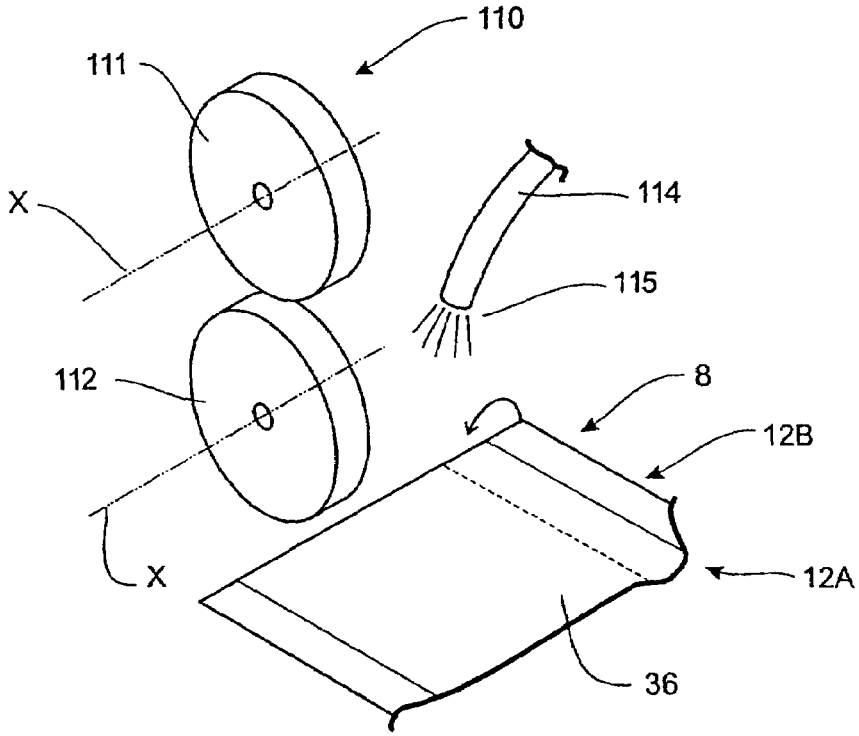
FIG. 34A is a perspective view of pinch roller wheels used for adhering the hem.
Figure 35:
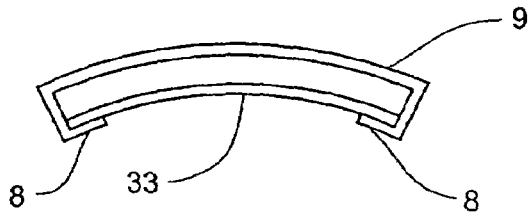
FIG. 35 illustrates the neckline perimeter fold of the breast cup.

A pre-folded condition is as for example shown in FIG. 34 whereas a subsequently folded condition is shown in FIG. 35. Such folding and bonding of the hem at the neck perimeter line 12 may include the use of an iron or a device to apply heat and pressure for the purposes of activating the adhesive coating tape for the bonding of the hem 8 at this region. Rather than utilising a iron to apply heat and pressure to the hem line to adhere the hem to the assembly 36, a device of a kind as for example shown in FIG. 34A may be utilised. The device 110 includes for example two pinch roller wheels 111 and 112. Alternatively it may be one pinch roller wheel 111 and one support surface which may operate in conjunction with each other. In the example shown in FIG. 34A, the pinch roller wheels 111 and 112 are placed so that their rotational axes X are substantially parallel to each other. The perimeter of the pinch roller wheels are proximate each other and may also preferably be biased towards each other. Intermediate of the perimeters of the wheels the assembly of plies can be fed. It can be seen that part of the assembly of plies is positioned ready to be inserted between the perimeter of the wheels 111 and 112. The hem can be folded onto the assembly of plies 36 to then have pressure applied between the pinch roller wheels 111 and 112. Hot air may be directed at the adhesive of the tape 44 from an outlet 115 via a conduit 114 to activate the region at which the hem 8 is to be adhered and/or the hem itself. Such hot air can activate the adhesive for the purposes of its adhering to the assembly of plies 36.

Figure 25:
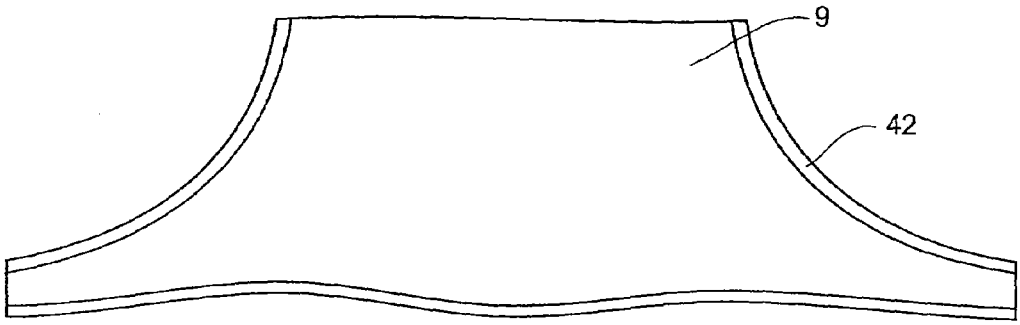
FIG. 25 illustrates the ply of fabric material having been trimmed along its lower and outer perimeter regions but not along the regions to be at the neckline perimeter of the bra.

A further advantage that is obtained from a subsequently defined hem 8 at the neckline perimeter 12 of the bra is that any variations, deviations or inaccuracies in the location of the exterior most ply 9 to the assembly 36 can be taken into consideration at the subsequent trimming of the neckline perimeter region of the exterior most ply 9. Such subsequent trimming can ensure that a taught exterior most ply 9 is provided over the assembly 36 of the bra. Were the neckline perimeter 12 of the exterior most ply 9 trimmed at the stage where the exterior most ply 9 has its outer perimeter line 10 and lower perimeter line 11 trimmed (see FIG. 25) any manufacturing deviations may then not have been able to be taken into account. However once the substantial part of the hem 8 has been formed at the outer and lower perimeter lines 10, 11 any such variations can be accounted for at the trimming stage of the exterior most ply 9 to define its neckline perimeter 12B. Shoulder straps may be applied to the bra by the use of ultrasonic methods of welding including for example the use of a machine to apply adhesive coated tape onto the strap and the bra and also any other thermal bonding method. Furthermore stitching may also be an alternative form however less preferred.

The invention claimed is:

1. A bra comprised of a layered assembly of a plurality of plies of moldable material, including:

two breast cups;

a respective chest band disposed at each of the breast cups, the chest bands extending toward each other;

the layered assembly including at least an inward ply disposed to be worn toward the body, the inward ply having an outward facing side and an opposite inward facing side, the layered assembly further including an outward ply outward of the inward ply and applied over the inward ply;

each chest band being a part of the inward ply and having a distal free end and a free end region near the distal free end;

a respective fastening unit attached to the outward facing side and not to the inward facing side of the respective inward ply at each free end region of the chest band, and the fastening units on the free end regions of the chest band are respectively complementary for enabling detachable connection between the fastening units for fastening the chest bands.

2. The bra as claimed in claim 1, wherein each fastening unit is attached to the respective free end region of the chest band by at least one selected from the group consisting of adhesive, adhesive coated tape, ironing induced fastening with adhesive coated tape, ultrasonic welding and stitching.

3. A bra comprised of a layered assembly of a plurality of plies of moldable material, including:

two breast cups;

a respective chest band disposed at each of the breast cups, the chest bands extending toward each other;

the layered assembly including at least an inward ply disposed to be worn toward the body and an outward ply outward of the inward ply and applied over the inward ply; the outward ply having an outward facing surface;

each chest band being a part of the inward ply and having a distal free end and a free end region near the distal free end;

the outward ply extends over the inward ply at the chest bands;

a respective fastening unit attached to the respective inward ply at each free end region of the chest band, and the fastening units on the free end regions of the chest band are respectively complementary for enabling detachable connection between the fastening units for fastening the chest bands, the outward ply having apertures therethrough at the free end region of the chest band and over the inward ply;

the outward and inward plies being attached to define the bra.

4. The bra of claim 3, wherein the fastening units attached to the inner ply include individual complementary fastening elements thereon;

fastening element apertures in the outer ply, the fastening elements being so positioned on the inward ply as to extend through the apertures in the outward ply and project above the outward facing side of the outward ply, and each aperture is of a width generally corresponding to a width of the respective fastening element projecting through the aperture, wherein there are no seams across the outer ply at the plurality of apertures.

5. The bra of claim 1, further comprising a respective perimeter region of the inward ply and the outward ply, the inward and outward plies being attached to each other at the respective perimeter regions.

6. The bra of claim 5, wherein the attachment of the inward ply to the outward ply at the perimeter regions is via a hem joining them.

7. A method of producing a bra comprising:

forming a bra of breast cups and of respective chest bands extending from each of the breast cups, wherein each chest band has a respective distal free end and extends toward the other chest band, and each chest band having a free end region at one side thereof and near the distal free end thereof;

applying a heat resistant wing panel to the one side of each of the chest bands, and positioning the wing panel to expose the free end region of the respective chest band at the one side of the chest band;

applying a fastening unit to the free end region of one side of the chest band distally of the wing panel while the wing panel is positioned on the chest band.

8. A method as claimed in claim 7, further comprising following applying the fastening unit to the respective free end region of the chest band, removing the wing panel from the chest band.

9. A method as claimed in claim 8, further comprising forming the bra by molding an outward ply to an inward ply to define the bra;

providing the chest band at the inward ply and applying the fastening unit without applying the outward ply on the inward ply; and after removing the wing panel, applying the outward ply over the inward ply.

10. The method as claimed in claim 7, wherein the fastening element is applied to the free end region of the chest band by at least one of adhesive, adhesive coated tape, ironing induced fastening with adhesive coated tape, ultrasonic welding and stitching.

11. A method as claimed in claim 8, wherein the chest band includes an inward ply and the wing panel and the fastening element being applied to the free end region of one side of the inward ply;

the method further comprising, after removing the wing panel from the chest band, applying an outward ply over the inward ply at the chest band at a location uncovering the fastening element at the free end region; and prior to applying the outer ply, forming a plurality of apertures in the outer ply through which respective fastening elements of the fastening unit will project above the outward facing side of the outward ply and each aperture is of a width generally corresponding to a width of the respective fastening element projecting through the aperture, wherein there are no seams across the outer ply at the plurality of apertures.

12. A method of producing a bra comprising:

forming a bra of breast cups and of respective chest bands extending from each of the breast cups, wherein each chest band has a respective distal free end and extends toward the other chest band, and each chest band having a free end region at one side thereof and near the distal free end thereof;

applying a fastening unit to the distal free end region of one side of the chest band, forming an outward ply for the bra and chest band and applying the outward ply over an inward ply of the chest band and over the fastening unit on the inward ply and prior to applying the outer ply, forming a plurality of apertures in the outer ply through which respective fastening elements of the fastening unit will project above an outward facing side of the outward ply and each aperture is of a width generally corresponding to a width of the respective fastening element projecting through the aperture, wherein there are no seams across the outer ply at the plurality of apertures.

13. A method as claimed in claim 12, further comprising applying a wing panel and the fastening element to the free end region of one side of the inward ply;

the method further comprising, after removal of the wing panel from the chest band, applying an outward ply over the inward ply at the chest band at a location uncovering the fastening element at the distal free end region.

14. A molded brassiere comprising:

an interior brassiere panel of at least one ply of a moldable material;

an exterior brassiere panel of at least one ply of a moldable material, wherein at least one of said plies of said exterior brassiere panel is contiguous with at least one of said plies of said interior brassiere panel, and wherein said panels are affixed together; and a clasp adhered between said interior and exterior brassiere panels for capturing the clasp intermediate of said interior and exterior brassiere panels, wherein said clasp is affixed to and at least in part projects from one of said interior and said exterior brassiere panels, and wherein one of said interior and exterior brassiere panels includes an aperture for that part of said clasp that projects from said interior and exterior brassiere panels to extend through.

15. A molded brassiere as claimed in claim 14 wherein said clasp is selected from one of a hook and an eye.

16. A molded brassiere as claimed in claim 15 wherein said interior and exterior brassiere panels each extends to define two breast cup regions of said brassiere and two chest band portions, each one of said chest band portions extending from a respective breast cup region to a free end of said chest band portion, wherein at said free end of one of said chest band portions, said clasp is located to present at least part of said connector through one of said interior and exterior brassiere panels for fastening with a complementary shaped connector engaged at the free end of the other of said chest band portions.

17. A molded brassiere as claimed in claim 16 wherein said other connector is selected from said hook and eye, the other of said chest band portions capturing a second clasp intermediate of said interior and exterior brassiere panels and including an opening through one of said interior brassiere panel and said exterior brassiere panel to allow at least part of said complementary shaped connector to pass therethrough.

18. A molded brassiere as claimed in claim 14 wherein said interior brassiere panel has a perimeter and said interior brassiere panel and said exterior brassiere panel are affixed together around a perimeter of said interior brassiere panel.

19. A molded brassiere that includes an exterior brassiere panel having at least one ply of moldable material and an interior brassiere panel having at least one ply of moldable material, said interior brassiere and exterior brassiere panels are contiguous to each other and define at least two breast cup regions and a chest band portion extending from each said breast cup region, said interior brassiere and exterior brassiere panels are affixed together, a clasp captured intermediate of and adhered to at least one of said interior and exterior brassiere panels, said chest band has a fastener which includes one of a hook and an eye that is affixed to the clasp and one of said interior and exterior brassiere panels including an opening through which said hook or eye extends.

20. A method of incorporating a fastener with a molded brassiere that includes an exterior brassiere panel of moldable material and an interior brassiere panel of moldable material that is contiguous with said exterior brassiere panel and is affixed thereto, and wherein said fastener includes a clasp, said method comprising:

creating an aperture in one of said exterior brassiere panel and said interior brassiere panel at a location to correspond with a distal end of a chest band of the brassiere and at a location thereof through which at least part of said fastener is to extend;

locating said clasp intermediate of said exterior brassiere panel and said interior brassiere panel in a manner to allow said at least part of said fastener to extend through said aperture;

adhering at least one of said exterior brassiere panel and said interior brassiere panel to said clasp, said adhering being at least one of an adhesive, heat welding, and ultrasonic welding;

wherein said method comprises applying heat and pressure to push said exterior brassiere and interior brassiere panels towards each other to affix at least one of said exterior and interior brassiere panels with one another.

21. A method as claimed in claim 20 wherein said clasp is selected from one of a hook and an eye.

* * * * *